US007746336B2

(12) United States Patent
Morita

(10) Patent No.: US 7,746,336 B2
(45) Date of Patent: Jun. 29, 2010

(54) POWER SOURCE CIRCUIT, DISPLAY DRIVER, ELECTRO-OPTIC DEVICE AND ELECTRONIC APPARATUS

(75) Inventor: Akira Morita, Suwa (JP)

(73) Assignee: Seiko Epson Corporation (JP)

( * ) Notice: Subject to any disclaimer, the term of this patent is extended or adjusted under 35 U.S.C. 154(b) by 1290 days.

(21) Appl. No.: 11/242,197

(22) Filed: Oct. 3, 2005

(65) Prior Publication Data

US 2006/0071928 A1 Apr. 6, 2006

(30) Foreign Application Priority Data

Oct. 6, 2004 (JP) ..... 2004-293607

(51) Int. Cl.
*G09G 5/00* (2006.01)

(52) U.S. Cl. ..... 345/211; 345/204; 345/212; 345/213; 345/214; 345/215

(58) Field of Classification Search ..... 345/204, 345/211–215
See application file for complete search history.

(56) References Cited

U.S. PATENT DOCUMENTS

| | | | | |
|---|---|---|---|---|
| 5,283,477 | A * | 2/1994 | Shibata | 327/306 |
| 5,455,534 | A | 10/1995 | Motegi et al. | |
| 6,496,175 | B1 * | 12/2002 | Fukuo | 345/99 |
| 6,762,565 | B2 * | 7/2004 | Kudo et al. | 315/169.2 |
| 7,034,797 | B2 | 4/2006 | Maki | |
| 7,119,802 | B2 | 10/2006 | Suyama et al. | |
| 2002/0167504 | A1 | 11/2002 | Matsumoto | |
| 2003/0151581 | A1 * | 8/2003 | Suyama et al. | 345/98 |
| 2004/0017341 | A1 * | 1/2004 | Maki | 345/87 |
| 2005/0052395 | A1 * | 3/2005 | Choi et al. | 345/98 |

FOREIGN PATENT DOCUMENTS

| | | |
|---|---|---|
| CN | 1467693 | 1/2004 |
| JP | 07-221560 | 8/1995 |
| JP | 10-319924 | 12/1998 |
| JP | 2000-347635 | 12/2000 |
| JP | 2001-188615 | 7/2001 |
| JP | 2002-303847 | 10/2002 |
| JP | 2002-333866 | 11/2002 |
| JP | 2002-366114 | 12/2002 |
| JP | 2003-216256 | 7/2003 |

* cited by examiner

*Primary Examiner*—Richard Hjerpe
*Assistant Examiner*—Saifeldin Elnafia
(74) *Attorney, Agent, or Firm*—Harness, Dickey & Pierce, P.L.C.

(57) ABSTRACT

A power supply circuit for supplying a voltage to a counter electrode which faces a pixel electrode in an electro-optic device, an electro-optic material being disposed between the counter electrode and the pixel electrode, includes: an operational amplifier which drives the counter electrode; and an operational amplifier control circuit which controls at least one of a slew rate and an electric current drive capacity of the operational amplifier. The operational amplifier control circuit increases at least one of the slew rate and the electric current drive capacity of the operational amplifier, during a control time starting at a start timing of a write-in to the pixel electrode, and brings the slew rate and the electric current drive capacity of the operational amplifier back to the state prior to the control time after passing the control time.

11 Claims, 14 Drawing Sheets

POWER SOURCE CIRCUIT, DISPLAY DRIVER, ELECTRO-OPTIC DEVICE AND ELECTRONIC APPARATUS

Japanese Patent Application No. 2004-293607, filed on Oct. 6, 2004, is hereby incorporated by reference in its entirety.

BACKGROUND OF THE INVENTION

The present invention relates to a power supply circuit, a display driver, an electro-optic device and an electronic apparatus.

An active-matrix liquid crystal display device has a plurality of scanning lines and data lines formed in matrix. It also has a plurality of switching elements, each of which is connected to a scanning line and a data line, and a plurality of pixel electrodes, each of which is connected to a switching element. The pixel electrodes are facing the counter electrodes through liquid crystal (in a broader sense, electro-optic material).

In a liquid crystal display device with such a structure, a voltage, supplied to the data line through the switching element activated by the selected scanning line, is applied to the pixel electrode. Then, corresponding to the voltage applied between the pixel electrode and the counter electrode, the transmittance of the pixel changes.

The liquid crystal in liquid crystal display devices needs to be driven in alternating current, so as to prevent the deterioration thereof. Therefore, a polarity inversion drive is performed in liquid crystal display devices, in which the polarity of the voltage between the pixel electrode and the counter electrode is inverted once per frame or at least once per horizontal scanning period. The polarity inversion drive is implemented by, for example, changing the voltage supplied to the counter electrode in synchronization with the polarity inversion timing.

Using operational amplifiers is an example of implementing the aforementioned polarity inversion drive by supplying a boosted voltage to the counter electrode with its charge pump operation.

JP-A-2002-366114 is an example of related art.

In the active-matrix liquid crystal display device, liquid crystal is inserted between the pixel electrodes and the counter electrodes, and the pixel electrodes and the counter electrodes are linked with capacitance component. Therefore, when the voltage supplied to the data line is applied (written in) to the pixel electrode via the switching element selected by the scanning line, the voltage level of the counter electrode changes at the time of voltage application, along with voltage fluctuation of the pixel electrode.

In this case, the operational amplifier can bring the voltage level of the counter electrode back to its original value at the write-in time of the pixel electrode, by increasing the output capacity of the operational amplifier (slew rate and electric current drive capacity). However, the output capacity enhancement of the operational amplifier results in an increase in power consumption.

In recent years, there has been a study to make the pixel finer and to attain a smaller display panel size, by forming a display panel (in a broader sense, an electro-optic device) typically a Liquid Crystal Display (LCD) panel with a Low Temperature Poly-Silicon (hereafter LTPS) process (a type of manufacturing process). With the LTPS process, a part or all of the driving circuit of the display panel can be formed directly on the panel substrate (for instance, a glass substrate), on which the pixel including the switching element (for instance, a Thin Film Transistor, or TFT), is formed.

For instance, a display panel utilizing the mobility of electric charge in the LTPS, may be provided with a demultiplexer that connects one data signal supply line to any one of the data lines for R, G, and B components; where, a data signal (drive voltage) is supplied to the data signal supply line, and the data lines for R, G, and B components can be connected to the pixel electrode of the R, G and B components (first through third color components composing one pixel). In this case, a multiplexed signal, into which the data signals for the R, G, and B components are handled with time-division, is supplied to the demultiplexer. Thereafter, the data signals for the color components are sequentially switched and output into the data lines for the R, G, and B components by the demultiplexer, and written in to the pixel electrode provided for each color component. Such configuration allows a reduction of the number of terminals for outputting the data signal to the data line from the driving circuit. Therefore, it is possible to cope with the data line number increase, which is the result of pixels fining, without being limited by a narrow pitch between the terminals.

However, in the case of driving the display panel provided with such a demultiplexer, the write-in time to the pixel electrode becomes all the more shorter, in comparison to the case of driving a normal display panel. Accordingly, it is necessary to further shorten the time of bringing the fluctuated (as described above) voltage level of the counter electrode back to its original value. In order to shorten the time, the output capacity of the operational amplifier that drives the counter electrode needs to be enhanced all the more, resulting in a further increase in power consumption.

SUMMARY

A first aspect of the invention relates to a power supply circuit for supplying a voltage to a counter electrode which faces a pixel electrode in an electro-optic device, an electro-optic material being disposed between the counter electrode and the pixel electrode, the power supply circuit comprising:

an operational amplifier which drives the counter electrode; and an operational amplifier control circuit which controls at least one of a slew rate and an electric current drive capacity of the operational amplifier, wherein the operational amplifier control circuit:

increases at least one of the slew rate and the electric current drive capacity of the operational amplifier, during a control time starting at a start timing of a write-in to the pixel electrode, and brings the slew rate and the electric current drive capacity of the operational amplifier back to the state prior to the control time after passing the control time.

A second aspect of the invention relates to a display driver for driving an electro-optic device including a pixel electrode specified by a scanning line and a data line of the electro-optic device, and a counter electrode which faces the pixel electrode, an electro-optic material being disposed between the counter electrode and the pixel electrode, the display driver comprising:

the above power supply circuit, which supplies a voltage to the counter electrode; and a driving circuit which drives the electro-optic device.

A third aspect of the invention relates to a display driver for driving an electro-optic device including a pixel electrode specified by a scanning line and a data line of the electro-optic device; a counter electrode which faces the pixel electrode, an electro-optic material being disposed between the counter electrode and the pixel electrode; and a demultiplexer for outputting a signal which is divided from a multiplexed signal, to each data line, the display driver comprising:

the above power supply circuit, which supplies a voltage to the counter electrode;

a multiplexing circuit which generates a multiplexed signal which a signal supplied to each data line of a plurality of data lines in the electro-optic device and multiplexed; and a driving circuit which drives the data line of the electro-optic device, based on the multiplexed signal.

A fourth aspect of the invention relates to an electro-optic device comprising:

a plurality of scanning lines;

a plurality of data lines;

a pixel electrode specified by one of the plurality of scanning lines and one of the plurality of data lines;

a counter electrode facing the pixel electrode, an electro-optic material being disposed between the counter electrode and the pixel electrode;

a demultiplexer for outputting a signal divided from a multiplexed signal, to each data line;

a scanning driver which scans the plurality of scanning lines;

a data driver which drives the plurality of data lines; and the above power supply circuit, which supplies a voltage to the counter electrode.

A fifth aspect of the invention relates to an electro-optic device comprising:

a plurality of scanning lines;

a plurality of data lines;

a pixel electrode specified by one of the plurality of scanning lines and one of the plurality of data lines;

a counter electrode facing the pixel electrode, an electro-optic material being disposed between the counter electrode and the pixel electrode;

a scanning driver which scans the plurality of scanning lines;

a data driver which drives the plurality of data lines; and the above power supply circuit which supplies a voltage to the counter electrode.

A sixth aspect of the invention relates to an electronic apparatus comprising the above power supply circuit.

A seventh aspect of the invention relates to an electronic apparatus comprising the above display driver.

An eighth aspect of the invention relates to an electronic apparatus comprising the above electro-optic device.

DETAILED DESCRIPTION OF THE EMBODIMENTS

Figure 1:
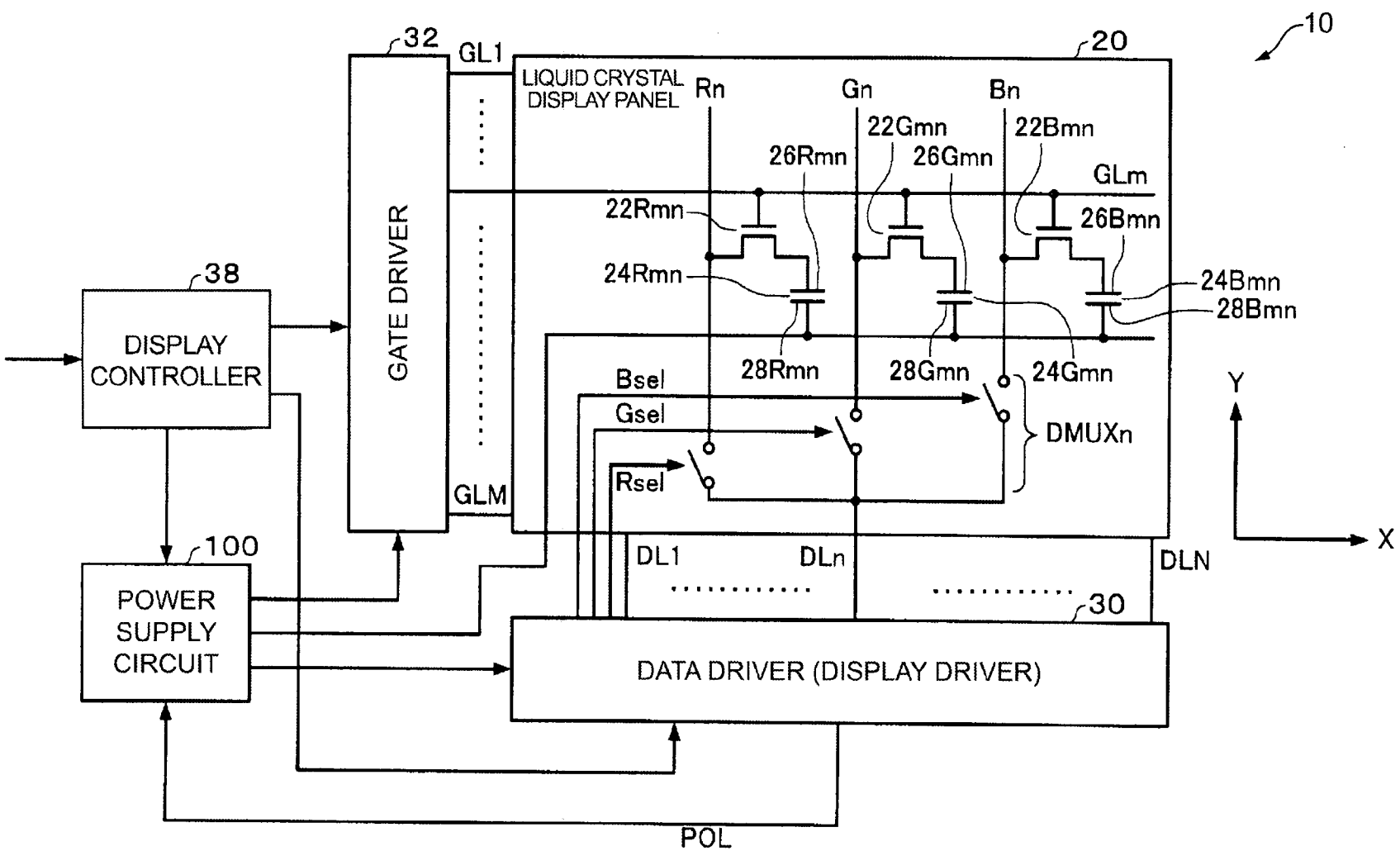
FIG. 1 is an illustration that shows a schematic structure of a liquid crystal display device in the embodiment.

The invention may provide a power supply circuit, a display driver, an electro-optic device and an electric apparatus, which have the ability to reduce the voltage level fluctuation of the counter electrode, in a low power consumption, even when the write-in time to the pixel electrode shortens.

An embodiment of the invention provides a power supply circuit for supplying a voltage to a counter electrode which faces a pixel electrode in an electro-optic device, an electro-optic material being disposed between the counter electrode and the pixel electrode, the power supply circuit comprising:

an operational amplifier which drives the counter electrode; and an operational amplifier control circuit which controls at least one of a slew rate and an electric current drive capacity of the operational amplifier, wherein the operational amplifier control circuit:

increases at least one of the slew rate and the electric current drive capacity of the operational amplifier, during a control time starting at a start timing of a write-in to the pixel electrode, and brings the slew rate and the electric current drive capacity of the operational amplifier back to the state prior to the control time after passing the control time.

In the case where the pixel electrode and the counter electrode are linked with capacitance component, the voltage level of the counter electrode fluctuates due to the write-in to the pixel electrode. Here, according to the first embodiment of the invention, either one or both of the slew rate and the electric current drive capacity of the operational amplifier are controlled, so as to be increased in the control time, during which the write-in to the pixel electrode starts. Therefore, the voltage level of the fluctuated counter electrode can be instantaneously brought back to the level prior to the write-in. Further, the output capacity of the operational amplifier (slew rate and electric current drive capacity) can be increased only when necessary, so that during the rest of the period, the output capacity of the operational amplifier can be decreased. Consequently, a power supply circuit, which allows suppressing of the power consumption increase, while promptly regaining the voltage level of the counter electrode to its original level, can be provided.

With this power supply circuit, the operational amplifier control circuit may include:

a first operational amplifier configuration register in which a first configuration data is set in order to specify at least one of the slew rate and the electric current drive capacity of the operational amplifier; and a second operational amplifier configuration register in which a second configuration data is set in order to specify at least one of the slew rate and the electric current drive capacity of the operational amplifier, and the operational amplifier control circuit may control:

at least one of the slew rate and the electric current drive capacity of the operational amplifier, based on the first configuration data, during the control time; and at least one of the slew rate and the electric current drive capacity of the operational amplifier, after a duration of the control time, based on the second configuration data.

In this case, the power supply circuit may include a timer circuit which starts a count after the start timing of the write-in to the pixel electrode, and specifies a period, which is up to a certain count value selected from one or more count values.

In the above embodiments of the invention, the slew rate, electric current drive capacity, and the control time are variable; hence, a simple-structured power supply circuit, which drives the counter electrode in a low power consumption and an optimal output capacity, can be provided.

With this power supply circuit, in a case where a signal divided from a multiplexed signal is supplied to the pixel electrode, the multiplexed signal being a signal supplied to each data line of a plurality of data lines in the electro-optic device and multiplexed in time-division, the start timing of the write-in may be the time-division timing of the multiplex signal.

In the above embodiment of the invention, the power supply circuit, which drives the counter electrode of the electro-optic device driven in the multiplex drive in a low power consumption, can be provided.

An embodiment of the invention provides a display driver for driving an electro-optic device including a pixel electrode specified by a scanning line and a data line of the electro-optic device, and a counter electrode which faces the pixel electrode, an electro-optic material being disposed between the counter electrode and the pixel electrode, the display driver comprising:

the above power supply circuit, which supplies a voltage to the counter electrode; and a driving circuit which drives the electro-optic device.

An embodiment of the invention provides a display driver for driving an electro-optic device including a pixel electrode specified by a scanning line and a data line of the electro-optic device; a counter electrode which faces the pixel electrode, an electro-optic material being disposed between the counter electrode and the pixel electrode; and a demultiplexer for outputting a signal which is divided from a multiplexed signal, to each data line, the display driver comprising:

the above power supply circuit, which supplies a voltage to the counter electrode;

a multiplexing circuit which generates a multiplexed signal which a signal supplied to each data line of a plurality of data lines in the electro-optic device and multiplexed; and a driving circuit which drives the data line of the electro-optic device, based on the multiplexed signal.

In the above embodiments of the invention, the display driver, which includes the power supply circuit that has the ability to reduce the voltage level fluctuation of the counter electrode, in a low power consumption, even when the write-in time to the pixel electrode shortens, can be provided.

An embodiment of the invention provides an electro-optic device comprising:

a plurality of scanning lines;

a plurality of data lines;

a pixel electrode specified by one of the plurality of scanning lines and one of the plurality of data lines;

a counter electrode facing the pixel electrode, an electro-optic material being disposed between the counter electrode and the pixel electrode;

a demultiplexer for outputting a signal divided from a multiplexed signal, to each data line;

a scanning driver which scans the plurality of scanning lines;

a data driver which drives the plurality of data lines; and the above power supply circuit, which supplies a voltage to the counter electrode.

An embodiment of the invention provides an electro-optic device comprising:

a plurality of scanning lines;

a plurality of data lines;

a pixel electrode specified by one of the plurality of scanning lines and one of the plurality of data lines;

a counter electrode facing the pixel electrode, an electro-optic material being disposed between the counter electrode and the pixel electrode;

a scanning driver which scans the plurality of scanning lines;

a data driver which drives the plurality of data lines; and the above power supply circuit, which supplies a voltage to the counter electrode.

In the above embodiments of the invention, the electro-optic device, which includes the power supply circuit that has the ability to reduce the voltage level fluctuation of the counter electrode, in a low power consumption, even when the write-in time to the pixel electrode shortens, can be provided.

An embodiment of the invention provides an electronic apparatus comprising the above power supply circuit.

An embodiment of the invention provides an electronic apparatus comprising the above display driver.

An embodiment of the invention provides an electronic apparatus comprising the above electro-optic device.

In the above embodiments of the invention, the electric apparatus, which includes the power supply circuit, etc., which have the ability to reduce the voltage level fluctuation of the counter electrode, in a low power consumption, even when the write-in time to the pixel electrode shortens, can be provided.

Embodiments of the invention are described below in detail with reference to the drawings. Note that the embodiments described hereunder do not in any way limit the scope of the invention defined by the claims laid out herein. Note also that not all of the elements of these embodiments should be taken as essential requirements to the means of the present invention. For example, in the embodiment below, the description explains about the liquid crystal display panel on which a demultiplexer is formed by the LTPS process. However, the present invention shall not be limited to this configuration.

1. Liquid Crystal Display Device

In FIG. 1, the schematic structure of the active-matrix liquid crystal display device in the embodiment is shown.

A liquid crystal display device 10 includes a liquid crystal display panel 20 (in a broader sense, a display panel; and in a further broader sense, an electro-optic device). The liquid crystal display panel 20 is formed on, for instance a glass substrate, with the LTPS process. On the glass substrate, scanning lines GL1 through GLM, and data signal supply lines DL1 through DLN are arranged, where the scanning lines are arrayed in multiple lines in the direction of the Y-axis, and each one is stretched in the direction of the X-axis; and the data signal supply lines are arrayed in multiple lines in the direction of the X-axis, and each one is stretched in the direction of the Y-axis. Here, M and N are integers equal to or larger than 2. On the glass substrate, data lines for color component are arranged for each color component that constitutes one pixel. In FIG. 1, data lines for R component R1 through RN, data lines for G component G1 through GN, and data lines for B component B1 through BN, the data lines for R, G and B components being "data lines" in a broader sense, are arranged. The data lines for R component R1 through RN, the data lines for G component G1 through GN, and the data lines for B component B1 through BN are also arranged in multiple lines in the direction of X-axis, stretching in the direction of the Y-axis.

The data signal supply line DLn (n is an integer satisfying $1 \leqq n \leqq N$) is electrically connected to any one of the data line for R component Rn, the data line for G component Gn, and the data line for B component Bn, through a demultiplexer DMUXn. Each demultiplexer is installed for every data signal supply line. The demultiplexer DMUX1 through DMUXN divides the multiplexed data signal with multiplex signals Rsel, Gsel, and Bsel.

Corresponding to an intersection of the scanning line GLm (m is an integer satisfying $1 \leqq m \leqq M$) and the data line for R component Rn, a pixel region (pixel) is provided, in which a thin-film transistor 22Rmn (hereafter TFT22Rmn) is arranged. Corresponding to the intersection of the scanning line GLm and the data line for G component Gn, the pixel region is provided, in which a TFTGmn is arranged. Corresponding to the intersection of the scanning line GLm and the data line for B component Bn, the pixel region is provided, in which a TFT22Bmn is arranged. Gates of TFT22Rmn, 22Gmn, and 22Bmn are connected to the scanning line GLm.

A source of the TFT22Rmn is connected to the data line for R component Rn. A drain of the TFT22Rmn is connected to a pixel electrode 26Rmn. Between the pixel electrode 26Rmn and a counter electrode 28Rmn that faces it, liquid crystal (in a broader sense, electro-optic material) is filled in, forming a liquid crystal capacitor 24Rmn (in a broader sense, a liquid crystal element). Corresponding to the voltage applied between the pixel electrode 26Rmn and the counter electrode 28Rmn, the transmittance of the pixel changes. A counter electrode voltage VCOM is supplied to the counter electrode 28Rmn.

The source of the TFT22Gmn is connected to the data line for G component Gn. The drain of the TFT22Gmn is connected to a pixel electrode 26Gmn. Between the pixel electrode 26Gmn and a counter electrode 28Gmn that faces it, the liquid crystal is filled in, forming a liquid crystal capacitor 24Gmn. Corresponding to the voltage applied between the pixel electrode 26Gmn and the counter electrode 28Gmn, the transmittance of the pixel changes. The counter electrode voltage VCOM is supplied to the counter electrode 28Gmn.

The source of the TFT22Bmn is connected to the data line for B component Bn. The drain of the TFT22Bmn is connected to a pixel electrode 26Bmn. Between the pixel electrode 26Bmn and a counter electrode 28Bmn that faces it, the liquid crystal is filled in, forming a liquid crystal capacitor 24Bmn. Corresponding to the voltage applied between the pixel electrode 26Bmn and the counter electrode 28Bmn, the transmittance of the pixel changes. The counter electrode voltage VCOM is supplied to the counter electrode 28Bmn.

Such liquid crystal display panel 20 is formed, for instance, by adhering a first substrate on which the pixel electrodes and the TFTs are formed, to a second substrate on which the counter electrodes are formed, then filling in the liquid crystal, which is the electro-optic material, between the two substrates.

The liquid crystal display device 10 includes a data driver 30 (in a broader sense, a display driver). The data driver 30 drives the data signal supply lines DL1 through DLN on the liquid crystal display panel 20, based on the display data. More specifically, the data signal, which is supplied to data lines for each color component, in correspondence to the display data, is multiplexed in time-division into the multiplexed signal. Using the multiplexed signal, the data driver 30 drives the data signal supply lines DL1 through DLN of the liquid crystal display panel 20.

The liquid crystal display device 10 may also include a gate driver 32 (in a broader sense, a display driver). The gate driver 32 sequentially drives (scans) the scanning lines G11 through GLM of the liquid crystal display panel 20, during one vertical scanning period.

The liquid crystal display device 10 includes a power supply circuit 100. The power supply circuit 100 generates voltages necessary for driving the data line (data signal supply line), and supplies them to the data driver 30. The power supply circuit 100 generates voltages, for instance, source voltages VDDH and VSSH that are necessary for driving the data line (data signal supply line) of the data driver 30, or a voltage for logic section of the data driver 30. The power supply circuit 100 generates a voltage necessary for scanning the scanning line, and supplies it to the gate driver 32.

Moreover, the power supply circuit 100 generates the counter electrode voltage VCOM, and drives the counter electrode. More specifically, the power supply circuit 100 outputs the counter electrode voltage VCOM to the counter electrode of the liquid crystal display panel 20, in synchronization with a polarity inversion signal POL generated by the data driver 30, where the counter electrode voltage VCOM repetitively takes two levels of a high-potential voltage VCOMH and a low-potential voltage VCOML periodically.

The liquid crystal display device 10 may also include a display controller 38. The display controller 38 controls the data driver 30, the gate driver 32, and the power supply circuit 100, in accordance to what is set by a host such as a Central Processing Unit (hereafter CPU), not shown. For example, the display controller 38 sets the operation mode, the polarity inversion drive, and the polarity inversion timing, and supplies internally-generated vertical synchronization signals and horizontal synchronization signals, to the data driver 30 and the gate driver 32.

In FIG. 1, the liquid crystal display device 10 is configured to include the power supply circuit 100 or the display controller 38, while at least one of them may also be installed outside the liquid crystal display device 10. Alternatively, the liquid crystal display device 10 may also be configured to include the host.

Further, at least one of the gate driver 32 and the power supply circuit 100 may also be built-in to the data driver 30.

Still further, any one of (or all of) the data driver 30, gate driver 32, display controller 38 or power supply circuit 100, may be formed on the liquid crystal display panel 20. For example, the data driver 30, the gate driver 32 and the power supply circuit 100 are formed on the liquid crystal display panel 20. As described, the liquid crystal display panel 20 can be configured to include: a plurality of scanning lines; a plurality of data lines; a pixel electrode specified by one of the plurality of scanning lines and one of the plurality of data lines; a counter electrode facing the pixel electrode across the electro-optic material; a scanning driver which scans the plurality of scanning lines; a data driver which drives the plurality of data lines (data signal supply line); a demultiplexer for outputting a signal which is divided from a multiplexed signal, to each data line, the multiplexed signal being output by the data driver to the data line; and the power supply circuit, which supplies the counter electrode voltage to the counter electrode. The plurality of pixels is formed in a pixel-forming region 80 of the liquid crystal display panel 20.

1.1 The Polarity Inversion Drive Method

When driving liquid crystal for display, it is necessary to periodically discharge the electric charge stored in the liquid crystal capacitor, in order to maintain the liquid crystal's durability and contrast. Therefore, in the liquid crystal display device 10, polarity of the voltage applied to the liquid crystal in given period is inverted by the polarity inversion drive. The method of this polarity inversion drive includes a frame inversion drive or a line inversion drive, for instance.

The frame inversion drive is a method to invert the polarity of the voltage applied to the liquid crystal per frame. On the other hand, the line inversion drive is a method to invert the polarity of the voltage applied to the liquid crystal per line. In the line inversion drive, as in the frame inversion drive, the polarity of the voltage applied on the liquid crystal is, per line, inverted in one frame-period.

Figure 3A:
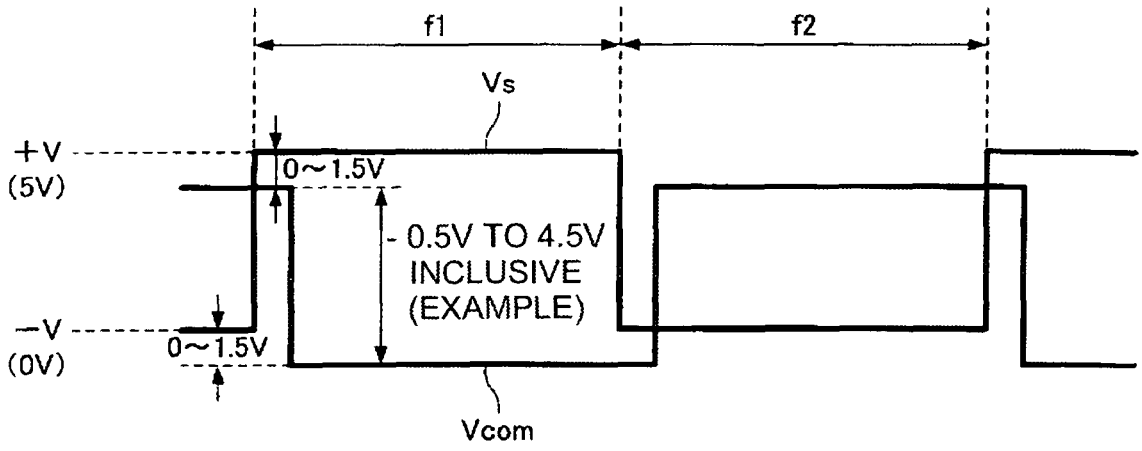
FIG. 3A and FIG. 3B are the illustrations that describe an operation of a frame inversion drive.
Figure 3B:
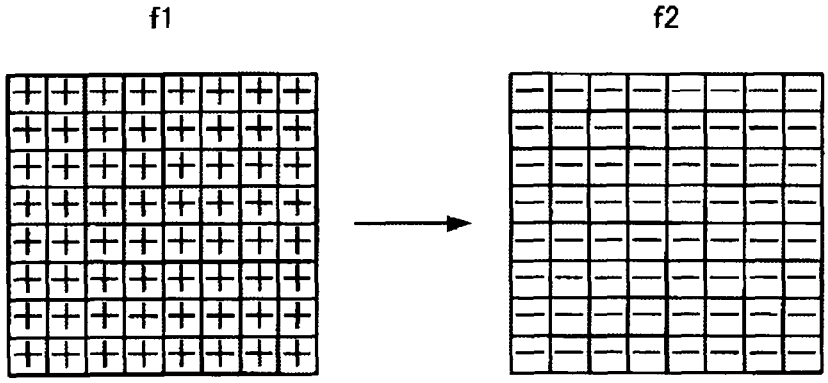

FIG. 3A and FIG. 3B are illustrations that describe an operation of the frame inversion drive. FIG. 3A illustrates the wave patterns of the data line drive voltage and the counter electrode voltage VCOM, in the frame inversion drive. FIG. 3B illustrates the polarity patterns of the voltages per frame in the frame inversion drive, the voltages being applied to the liquid crystal that corresponds to each pixel.

In the frame inversion drive, the polarities of the drive voltages applied to the data line are inverted once per single frame period, as shown in FIG. 3A. In other words, a voltage Vs supplied to the source of the TFT connected to the data line is positive ("+V") in a frame f1, and negative ("−V") in a subsequent frame f2. At the same time, the counter electrode voltage VCOM, which is supplied to the counter electrode that faces the pixel electrode connected to the drain electrode of the TFT, is also inverted in synchronization with the polarity inversion timing of drive voltage of the data line.

The magnitude of the voltage applied to the liquid crystal is equal to the voltage level difference between the pixel electrode and the counter electrode. As shown in FIG. 3B, the type of voltage applied here is positive in frame f1, and negative in frame f2.

Figure 4A:
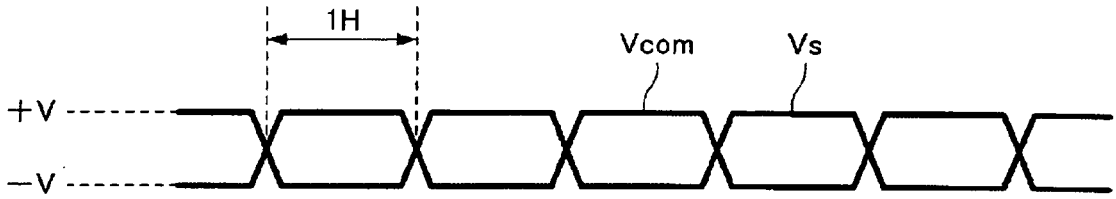
FIG. 4A and FIG. 4B are the illustrations that describe an operation of a line inversion drive.
Figure 4B:
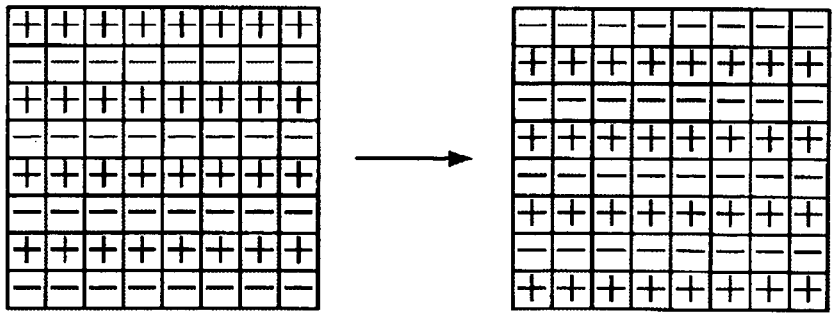

FIG. 4A and FIG. 4B are illustrations that describe an operation of the line inversion drive. FIG. 4A illustrates the wave patterns of the data line drive voltage and the counter electrode voltage VCOM, in the line inversion drive. FIG. 4B illustrates the polarity patterns of the voltages per frame in the line inversion drive, the voltages being applied to the liquid crystal that corresponds to each pixel.

In the line inversion drive, the polarities of the drive voltages applied to the data line are inverted once per each horizontal scanning period (1H) as well as per single frame period, as shown in FIG. 4A. In other words, the voltage Vs supplied to the source of the TFT connected to the data line is positive ("+V") in a period 1H of the frame f1, and negative ("−V") in a subsequent period 2H of the frame f1. In the frame f2, the voltage Vs turns to negative ("−V") in the 1H, and positive ("+V") in the 2H.

At the same time, the counter electrode voltage VCOM, which is supplied to the counter electrode that faces the pixel electrode connected to the drain electrode of the TFT, is also inverted in synchronization with the polarity inversion timing of drive voltage of the data line.

The magnitude of the voltage applied to the liquid crystal is equal to the voltage level difference between the pixel electrode and the counter electrode. This means, that by inverting the polarity per, for instance, scanning line, the voltage is applied once per frame-period in every line, as shown in FIG. 4B.

2. Data Driver

Figure 2:
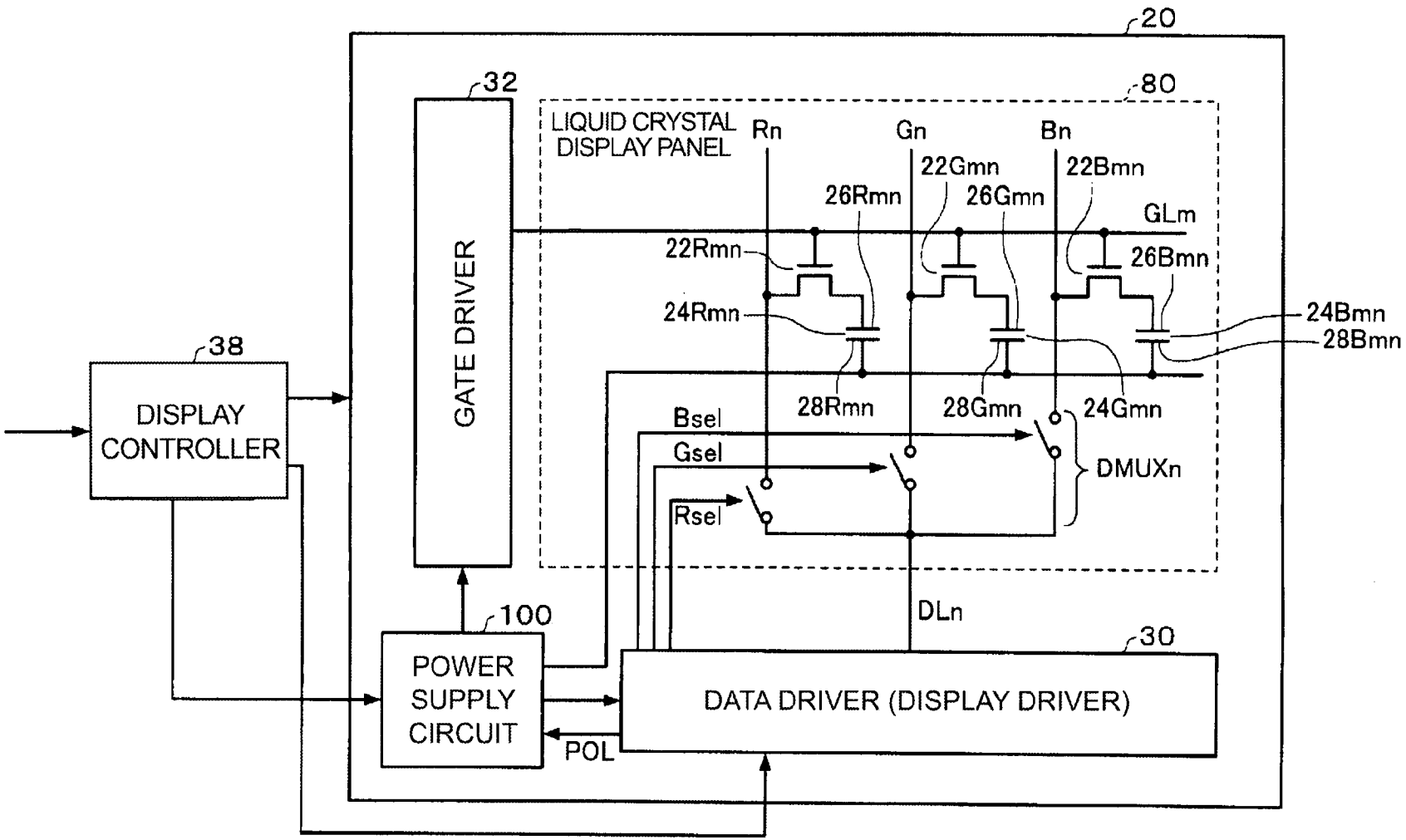
FIG. 2 is the illustration that shows another schematic structure of the liquid crystal display device in the embodiment.

The data driver 30 in FIG. 1 conducts a so-called "multiplex drive" to the liquid crystal panel 20 (shown in FIGS. 1 and 2) that is formed using the LTPS process.

Figure 5:
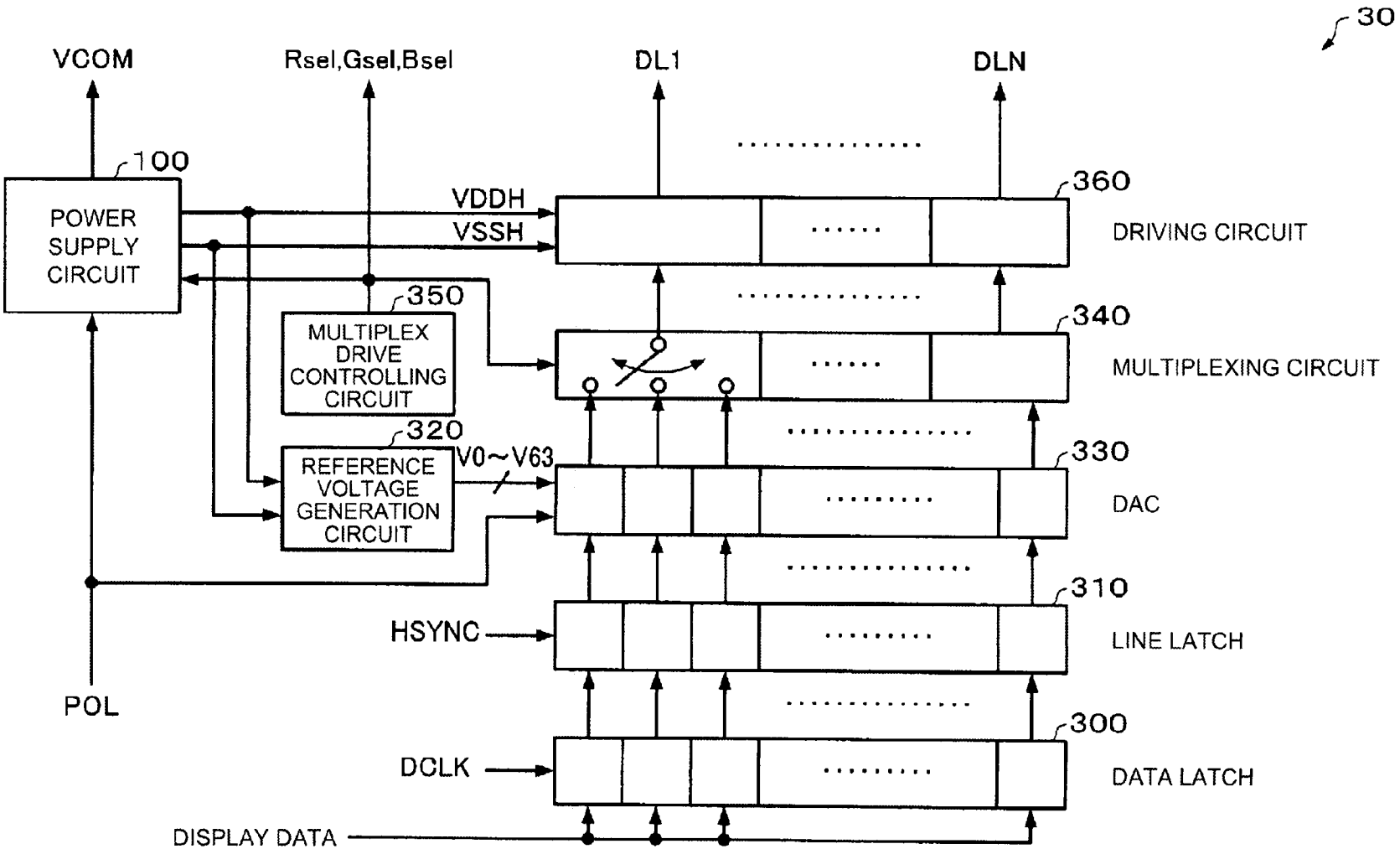
FIG. 5 is a block diagram of an example structure of a data driver in FIG. 1.

In FIG. 5, a block diagram of an example structure of the data driver in FIG. 1 is shown. In FIG. 5, the example structure of the case, where the data driver 30 includes the power supply circuit in the embodiment, is shown.

The data driver 30 includes: a data latch 300, a line latch 310, a reference voltage generation circuit 320, a Digital/Analog Converter 330 (hereafter DAC, and in a broad sense, a voltage switching circuit), a multiplexing circuit 340, a multiplex drive controlling circuit 350, a driving circuit 360, and the power supply circuit 100.

The data latch 300 retrieves the display data for, for instance, one horizontal scanning, by shifting the display data input serially by one pixel unit (or by one dot unit), in synchronization with a dot clock DCLK. The dot clock DCLK is supplied by the display controller 38. If one pixel is composed of 6-bit R, G, and B components, one pixel (3 dots) is 18 bits long.

The display data retrieved into the data latch 300 is latched to the line latch 310 at the change timing of a horizontal synchronization signal HSYNC.

The reference voltage generation circuit 320 generates a plurality of reference voltages, where each reference voltage corresponds to a display data. More specifically, the reference voltage generation circuit 320 generates the plurality of reference voltages V0 through V63, each of which corresponds to each 6-bit configuration display data, based on the source voltage VDDH at a high potential, and on the source voltage VSSH at a low potential.

The DAC 330 generates the analog drive voltages that correspond to the display data output from the line latch 310. More specifically, the DAC 330 selects the reference voltage corresponding to the display data for one data line (the data line for the color component), the display data being output from the line latch 310, from the plurality of reference voltages V0 through V63 that are generated by the reference voltage generation circuit 320, and then outputs the selected reference voltage as the drive voltage.

The multiplexing circuit 340 generates the multiplexed signal by time-division multiplexing of the drive voltages for each color component that constitutes one pixel. The multiplexed signal is generated per every output line. In FIG. 5, the multiplexing circuit 340 multiplexes the drive voltages for R, G, and B components that make up one pixel, using the multiplex signals Rsel, Gsel, and Bsel, per every output line.

The multiplex drive controlling circuit 350 generates the multiplex signals Rsel, Gsel, and Bsel. The multiplex signals Rsel, Gsel, and Bsel are also supplied to the demultiplexer DMUX1 through DMUXN of the liquid crystal display panel 20.

The driving circuit 360 drives the plurality of output lines, each of which is connected to a data signal supply line of the liquid crystal display panel 20. More specifically, the driving circuit 360 drives each output line, based on the multiplexed signal (multiplexed drive voltage) that is generated per every output line by the multiplexing circuit 340. The driving circuit 360 includes a plurality of data line driving circuit DRV-1 through DRV-N, each of which is corresponding to each output line. Each of the data line driving circuit DRV-1 through DRV-N is composed with an operational amplifier to which a voltage follower is connected.

The power supply circuit 100 generates the source voltage VDDH at a high potential and the source voltage VSSH at a low potential, based on the voltage between a system source voltage VDD and a system ground source voltage VSS. The source voltage VDDH at a high potential and the source voltage VSSH at a low potential are supplied to the reference voltage generation circuit 320 and to the driving circuit 360 (the data line driving circuit DRV-1 through DRV-N).

Furthermore, the power supply circuit 100 generates the high-potential voltage VCOMH and the low-potential voltage VCOML, which are supplied to the counter electrode. The power supply circuit 100 supplies the high-potential voltage VCOMH or the low-potential voltage VCOML to the counter electrode as a counter electrode voltage VCOM, based on the polarity inversion signal POL. At this time, the power supply circuit 100 drives the counter electrode by conducting an impedance conversion using operational amplifier, based on the counter electrode voltage VCOM.

In the data driver 30 with such configuration, display data for one horizontal scanning for instance, which is retrieved by the data latch 300, is latched with the line latch 310. The analog drive voltage is generated using the display data latched by the line latch 310, and are multiplexed per one output line. Then, the driving circuit 360 drives each output line, based on the multiplexed signal that is multiplexed in time-division by the multiplexing circuit 340.

Figure 6:
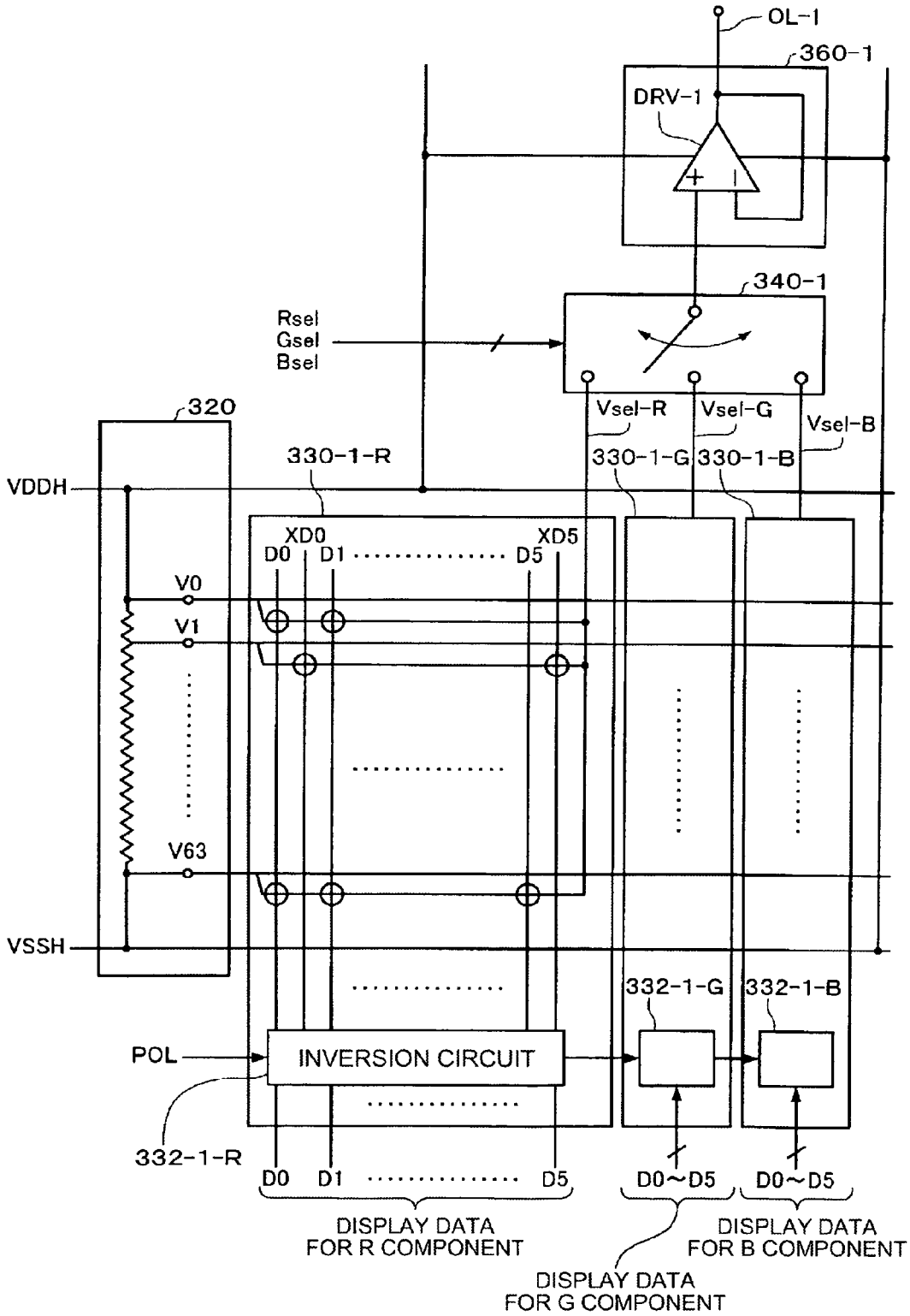
FIG. 6 is the illustration that shows a schematic structure of a reference voltage generation circuit, a Digital to Analog Converter (hereafter DAC), a multiplexing circuit, and a driving circuit.

In FIG. 6, a schematic structure of the reference voltage generation circuit 320, the DAC 330, the multiplexing circuit 340, and the driving circuit 360 are shown. Here, the structure for driving only one output line OL-1 is shown. However, the similar structure applies to other output lines as well.

In the reference voltage generation circuit 320, a resistor circuit is connected between the source voltage VDDH at a high potential and the source voltage VSSH at a low potential. Moreover, the reference voltage generation circuit 320 generates the plurality of divided voltages as the reference voltages V0 through V63, where the divided voltages are a result of the voltage level difference between the source voltage VDDH at a high potential and the source voltage VSSH at a low potential, divided into by the resistor circuit. In the case of the polarity inversion drive, the voltages with positive and negative polarity do not actually become symmetric; hence the reference voltage for positive polarity and the reference voltage for negative polarity are generated. In FIG. 6, one of the two is shown.

In FIG. 6, the analog drive voltages that correspond to the display data of R, G and B components are generated by DAC330-1-R, DAC330-1-G, and DAC330-1-B, in order to drive the output line OL-1. The DAC 330-1-R generates the analog drive voltages that correspond to the display data for R component. The DAC 330-1-G generates the analog drive voltages that correspond to the display data for G component. The DAC 330-1-B generates the analog drive voltages that correspond to the display data for B component.

Further, the multiplexing circuit 340-1 generates the multiplexed signal, based on the multiplex signals Rsel, Gsel, and Bsel, using the analog drive voltages that correspond to the display data for the R, G, and B components. This multiplexed signal becomes an input signal of the data line driving circuit DRV-1. More specifically, the multiplexing circuit 340-1 electrically connects the output of the DAC330-1-R to the input of the data line driving circuit DRV-1, if the multiplex signal Rsel is at H-level. The multiplexing circuit 340-1 electrically connects the output of the DAC330-1-G to the input of the data line driving circuit DRV-1, if the multiplex signal Gsel is at H-level. The multiplexing circuit 340-1 electrically connects the output of the DAC330-1-B to the input of the data line driving circuit DRV-1, if the multiplex signal Bsel is at H-level.

DAC330-1-R, 330-1-G, and 330-1-B can be implemented by a ROM decoder circuit. DAC330-1-R, 330-1-G, and 330-1-B select any one of the reference voltages V0 through V63 based on the 6-bit display data, and output them to the multiplexing circuit 340-1 as selected voltages Vsel-R, Vsel-G, and Vsel-B. Similarly, the selected voltages are output based on the corresponding 6-bit display data in other data line driving circuits DRV-2 through DRV-N.

The DAC330-1-R, 330-1-G, and 330-1-B include inversion circuits 332-1-R, 332-1-G, and 332-1-B. The inversion circuits 332-1-R, 332-1-G, and 332-1-B invert the display data based on the polarity inversion signal POL. Then, pieces of 6-bit display data D0 through D5 and 6-bit inverted display data XD0 through XD5 are input into each ROM decoder circuit. The inverted display data XD0 through XD5 is a result of the display data D0 through D5 being inverted. In the ROM decoder circuit, any one of the reference voltages V0 through V63 generated by the reference voltage generation circuit 320, is selected based on the display data.

For example, if the polarity inversion signal POL is at H-level, the reference voltage V2 is selected in accordance with the 6-bit display data D0 through D5 "000010", which represents 2. Moreover, if the polarity inversion signal POL is at L-level for instance, the reference voltage is selected by using the inverted display data XD0 through XD5, into which the display data D0 through D5 is inverted into. In other words, the inverted display data XD0 through XD5 is "111101", representing 61; thereby the reference voltage V61 is selected.

In this manner, the selected voltages Vsel-R, Vsel-G, and Vsel-B, which are selected by the DAC330-1-R, 330-1-G, and 330-1-B are supplied to the multiplexing circuit 340-1.

Then, data line driving circuit DRV-1 drives the output line OL-1, based on the multiplexed signal that is multiplexed in time-division by the multiplexing circuit 340-1. As mentioned above, the power supply circuit 100 changes the voltage of the counter electrode in synchronization with the polarity inversion signal POL. Consequently, it is possible to drive with the polarity of the voltage applied to the liquid crystal inverted.

As mentioned above, by building the power supply circuit 100 in the data driver 30, it is possible to cut down the packaging space of the liquid crystal display device, and to provide the data driver that allows low power consumption, while preventing image quality deterioration.

In FIGS. 5 and 6, the case of the power supply circuit being built-in to the data driver 30 is described. However, the power supply circuit may also be built-in to the gate driver 32.

Figure 7:
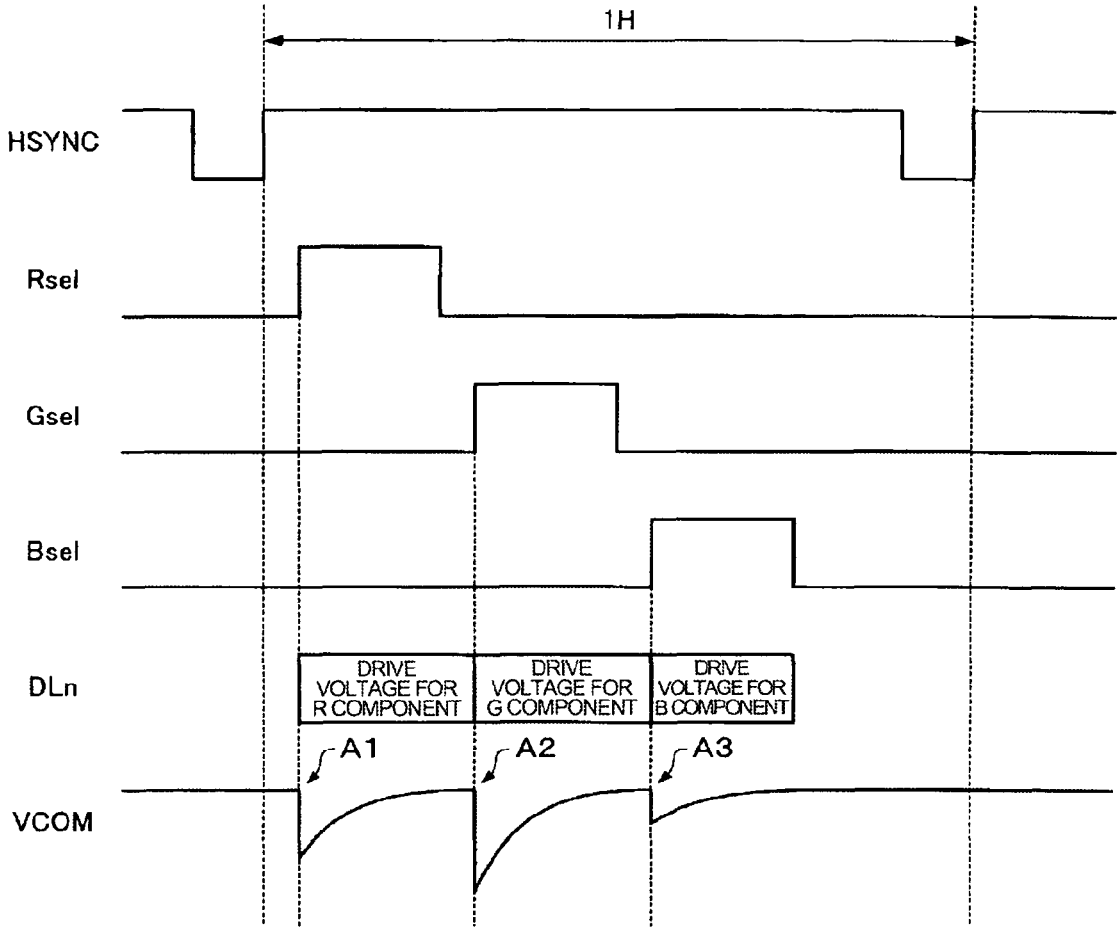
FIG. 7 is the illustration that describes the patterns of multiplex drive by a data driver shown in FIGS. 5 and 6.

In FIG. 7, the illustration that describes the patterns of multiplex drive by the data driver 30 shown in FIGS. 5 and 6, are shown.

The multiplex drive controlling circuit 350 generates the multiplex signals Rsel, Gsel, and Bsel in one horizontal scanning period (1H) regulated by the horizontal synchronization signal HSYNC, as show in FIG. 7. No more than one of multiplex signals Rsel, Gsel, and Bsel, may simultaneously be at H-level.

As described above, if the multiplex signal Rsel is at H-level, the multiplexing circuit 340-1 supplies the R component drive voltage to the data line driving circuit DRV-1. If the multiplex signal Gsel is at H-level, it supplies the G component drive voltage to the data line driving circuit DRV-1. If the multiplex signal Bsel is at H-level, it supplies the B component drive voltage to the data line driving circuit DRV-1. Thereafter, the multiplexed signal is divided into drive voltages by demultiplexer DMUX1 of the liquid crystal display panel 20, and each of the drive voltages are supplied to the data line for R component R1, the data line for G component G1, and the data line for B component B1.

In the active-matrix liquid crystal display device, the pixel electrode and the counter electrodes are linked with capacitance. Therefore, when the voltage supplied to the data line is written in to the pixel electrode via TFT selected by the scanning line, the voltage level of the pixel electrode changes at the time of the write-in. For example, in FIG. 7, the write-in start timings respectively correspond to timings A1, A2, and A3 when the multiplex signals Rsel, Gsel, and Bsel change their level from the L-level to H-level. At each of the timings, the voltage level of the counter electrode fluctuates corresponding to the written-in voltage level. Thereafter, the operational amplifier driving the counter electrode, operates in order to bring the fluctuated voltage level of the counter electrode back to the original level.

However, if the multiplex drive is performed with a tendency where the number of pixels in horizontal scanning direction increases while the one horizontal scanning period shortens, the write-in time to the pixel electrode becomes shorter. In such situation, there is not enough time ensured for the voltage level of the counter electrode to regain its original level, resulting in the image quality deterioration. Because of the above, it is necessary to increase the output capacity of the operational amplifier, consequently leading to an increase in the power consumption.

The power supply circuit 100 in the embodiment has the structure described hereafter, which allows suppressing of the power consumption increase, while promptly regaining the voltage level of the counter electrode to its original level.

3. Power Supply Circuit

Figure 8:
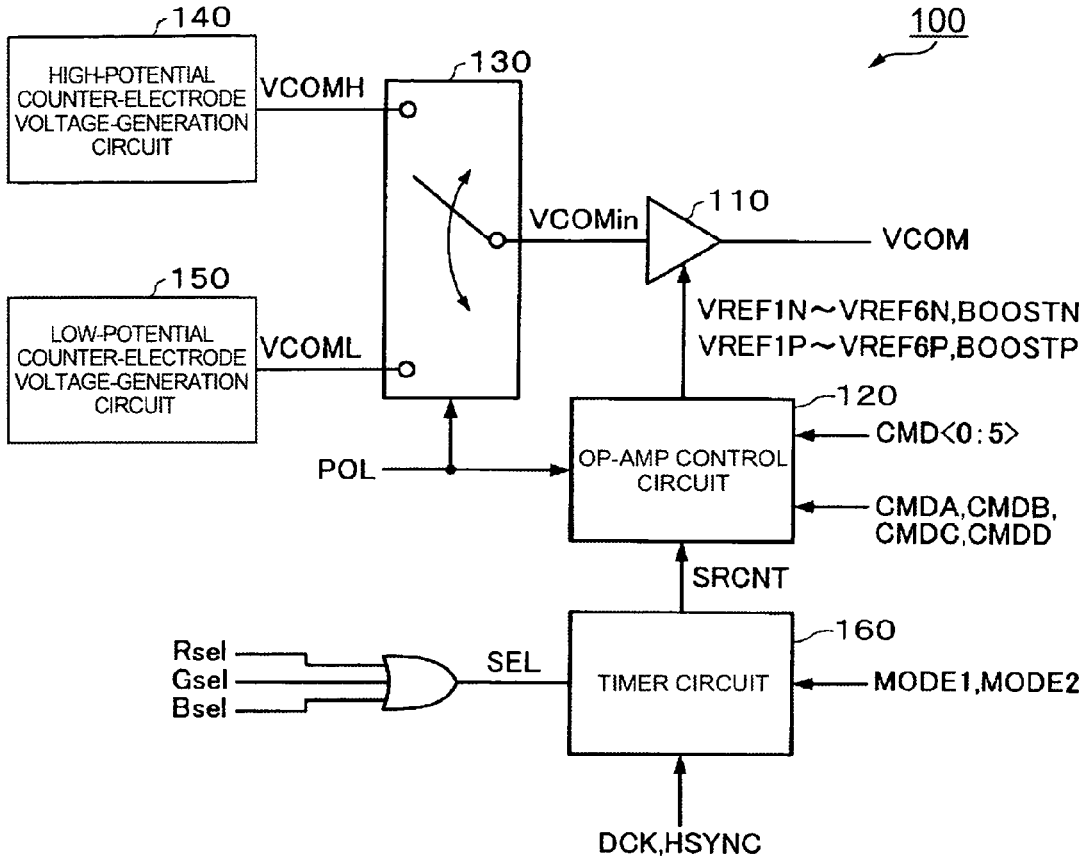
FIG. 8 is the block diagram of an example structure of a power supply circuit in the embodiment.

In FIG. 8, a block diagram of an example structure for the power supply circuit 100 in the embodiment is shown.

The power supply circuit 100 includes an operational amplifier 110 and the operational amplifier control circuit 120. The operational amplifier 110 drives the counter electrode. The operational amplifier control circuit 120 controls either one or both of a slew rate and an electric current drive capacity of the operational amplifier 110. The operational amplifier control circuit 120 increases either one or both of the slew rate and the electric current drive capacity of the operational amplifier 110, in a control time that starts at the start timing of the write-in to the pixel electrode. After the duration of the control time, it is desirable to bring the slew rate and the electric current drive capacity of the operational amplifier 110 back to the state prior to the control time. Here, the slew rate represents a value that indicates the maximum inclination of the output voltage in unit time.

That is to say, even if the voltage level of the counter electrode fluctuates due to the voltage write-in to the pixel electrode, either one or both of the slew rate and the electric current drive capacity of the operational amplifier 110 are controlled and increased in the control time, during which the write-in starts. Therefore, the voltage level of the fluctuated counter electrode can be instantaneously brought back to the voltage level prior to the write-in. Consequently, the output capacity of the operational amplifier 110 can be increased only when necessary, so that during the rest of the period, the output capacity of the operational amplifier 110 can be decreased. As a result, the power consumption can be suppressed to minimum.

The power supply circuit 100 includes a switching circuit 130, from which the output voltage is supplied to the operational amplifier 110 as an input voltage VCOMin. The switching circuit 130 outputs either the high-potential voltage VCOMH or the low-potential voltage VCOML as the input voltage VCOMin, based on the polarity inversion signal POL.

The power supply circuit 100 may include a high-potential counter-electrode voltage-generation circuit 140 and a low-potential counter-electrode voltage-generation circuit 150. The high-potential counter-electrode voltage-generation circuit 140 generates the high-potential voltage VCOMH. The low-potential counter-electrode voltage-generation circuit 150 generates the low-potential voltage VCOML. At least one of the high-potential counter-electrode voltage-generation circuit 140 and the low-potential counter-electrode voltage-generation circuit 150 generates voltages by, for instance, boosting the voltage impressed between the system source voltage VDD and the system ground source voltage VSS with a charge pump operation.

Figure 9:
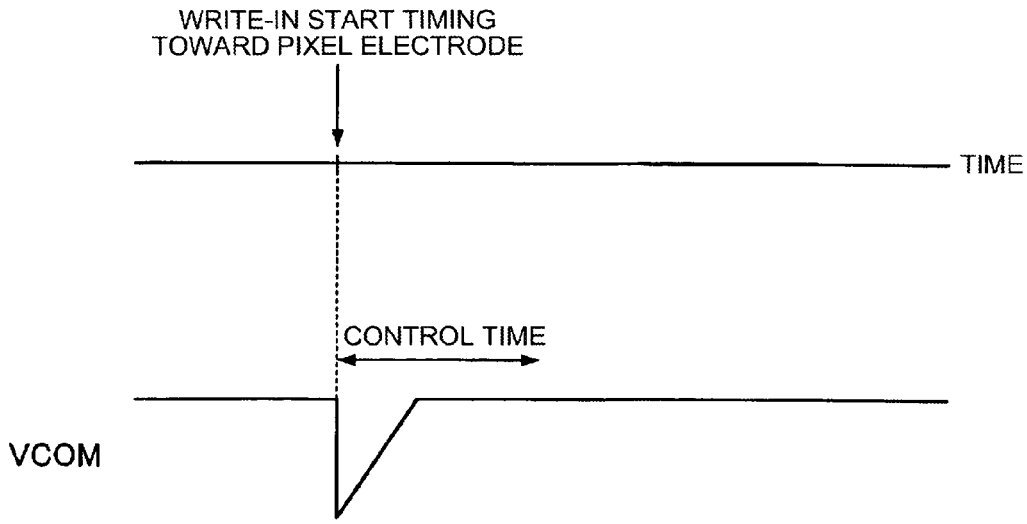
FIG. 9 is the illustration that describes the operation of the power supply circuit in FIG. 8.

The power supply circuit 100 may further include a timer circuit 160. As shown in FIG. 9, the operational amplifier control circuit 120 can conduct a control to increase either one or both of the slew rate and the electric current drive capacity of the operational amplifier 110, in a control time CT specified based on a control signal SRCNT from the timer circuit 160. The timer circuit 160 generates the control signal SRCNT that specifies the period, during which the counting, starting after the start timing of the write-in to the pixel electrode, reaches a prescribed count value, as the control time CT. Here, the write-in start timing of the pixel electrode is set by a write-in signal SEL, which is a result of a logic operation OR of multiplex signals Rsel, Gsel and Bsel. Thereby, the start timing of the write-in to the pixel electrode can be set to time-division timing of the multiplexed signal.

Hereafter, the example structure of the main unit of the power supply circuit 100 is described.

Figure 10:
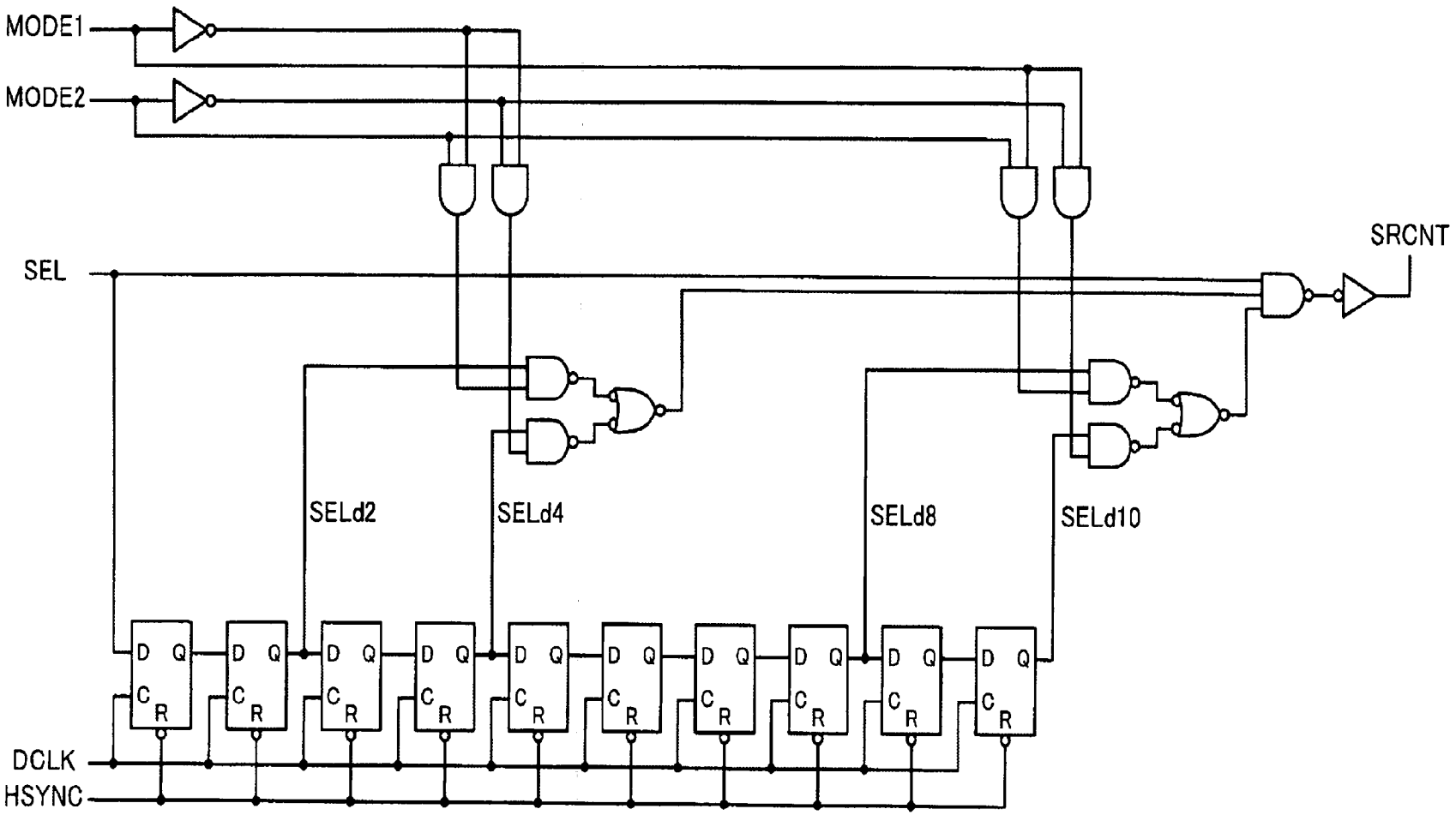
FIG. 10 is the illustration that describes a circuitry in the example structure of a timer circuit.

In FIG. 10, a circuit diagram of the example structure of the timer circuit 160 in FIG. 8 is shown.

In the timer circuit 160 shown in FIG. 10, the dot clock DCLK, the horizontal synchronization signal HSYNC, and the write-in signal SEL are input. Within one horizontal scanning period, the timer circuit 160 counts the clock ticks of the dot clock DCLK, starting from a change point of the write-in signal SEL, by shifting the write-in signal SEL in synchronization with the dot clock DCLK.

Moreover, the timer circuit 160 can specify the control time whose period is up to a certain count value, selecting it from one or more count value(s). In FIG. 10, mode signals MODE1 and MODE2 are input to the timer circuit 160; hence out of 4 count values, one count value can be specified by the mode signals MODE1 and MODE2. The mode signals MODE1 and MODE2 are output in accordance with the configuration of a mode configuration register (not shown) in the power supply circuit 100 (or the data driver 30), and the mode configuration register is accessed by the host or the display controller 38. In FIG. 10, any one of "2", "4", "8", or "10" clock ticks may be selected as the count value in the dot clock DCLK.

Figure 11:
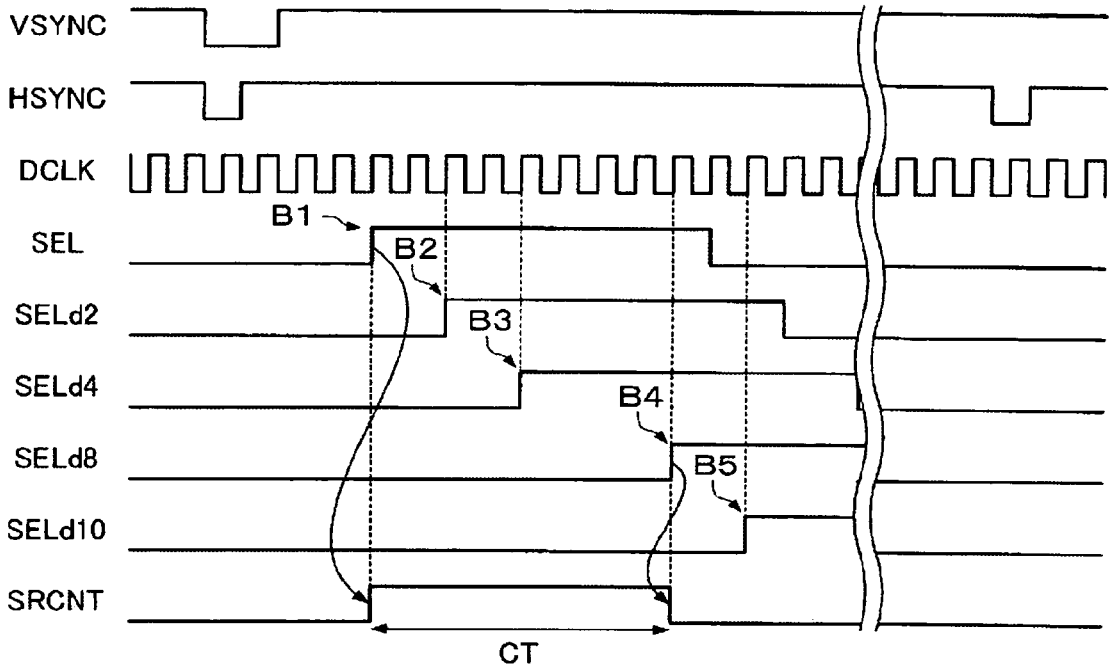
FIG. 11 is a timing chart of the operation example of the timer circuit in FIG. 10.

In FIG. 11, a timing chart of the operation example of the timer circuit 160 in FIG. 10 is shown. Here, the operation example of the case where "8" clock ticks is selected in the dot clock DCLK by the mode signals MODE1 and MODE2.

The horizontal scanning period starts at the time when the vertical synchronization signal VSYNC becomes L-level and the horizontal synchronization signal HSYNC switches from the L-level to H-level. Thereafter, during the horizontal scanning period, when the multiplex signal Rsel changes and the write-in signal SEL changes to H-level, the control signal SRCNT changes to H-level (B1).

The moment when the write-in signal SEL is shifted in synchronization with the dot clock DCLK, and when the dot clock DCLK is at "2" clock ticks, counting from the change point of the write-in signal SEL, a signal SELd2 changes to H-level (B2). Similarly, when the dot clock DCLK is at "4" clock ticks, a signal SELd4 changes to H-level (B3). When the dot clock DCLK is at "8" clock ticks, a signal SELd8 changes to H-level (B4). When the dot clock DCLK is at "10" clock ticks, a signal SELd10 changes to H-level (B5).

Since the count value is selected to be at "8" clock ticks in the dot clock DCLK by the mode signals MODE1 and MODE2, the control signal SRCNT changes to L-level when the signal SELd8 changes to H-level. Hence, the control time CT can be set to the period when the control signal SRCNT is at H-level.

Figure 12:
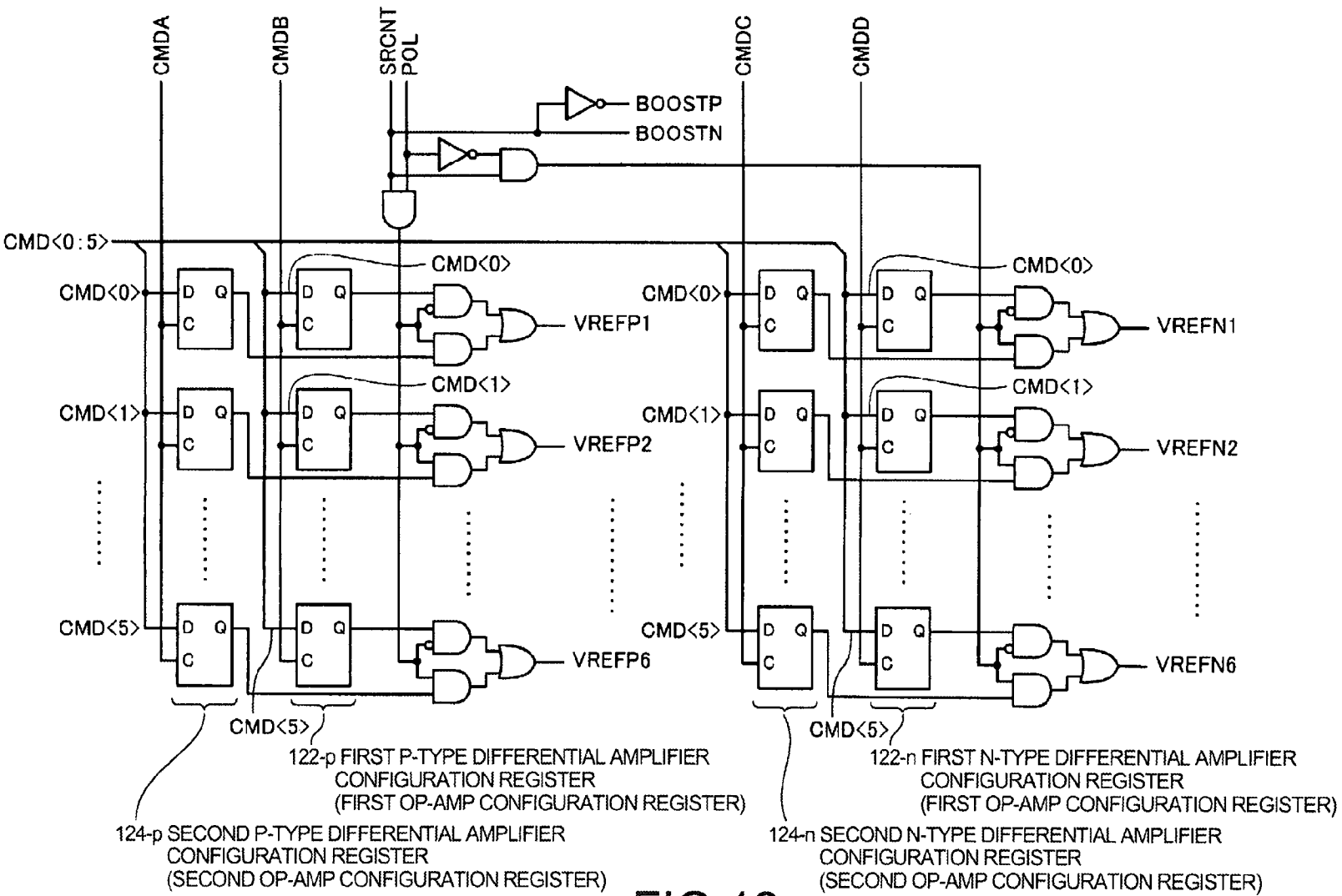
FIG. 12 is the illustration that describes the circuitry in the example structure of an operational amplifier control circuit.

In FIG. 12, a circuit diagram of the example structure of the operational amplifier circuit 120 in FIG. 8 is shown.

The operational amplifier control circuit 120 includes a first p-type (first conductive type) differential amplifier configuration register (in a broader sense, a first operational amplifier configuration register) 122-*p*, and a second p-type differential amplifier configuration register (in a broader sense, a second operational amplifier configuration register) 124-*p*. In FIG. 12, the first p-type differential amplifier configuration register 122-*p* and the second p-type differential amplifier configuration register 124-*p* are each composed of a 6-bit d-type flip-flop (hereafter D-FF).

A command configuration signal CMDB is input to a clock terminal C of the D-FF, each composing the first p-type differential amplifier configuration register 122-*p*. A signal for each bit of the command data CMD <0:5> is input to a data input terminal D of the D-FF, each composing the first p-type differential amplifier configuration register 122-*p*. A command configuration signal CMDA is input to the clock terminal C of the D-FF, each composing the second p-type differential amplifier configuration register 124-*p*. The signal for each bit of the command data CMD <0:5> is input to the data input terminal D of the D-FF, each composing the second p-type differential amplifier configuration register 124-*p*.

The operational amplifier control circuit 120 also includes a first n-type (second conductive type) differential amplifier configuration register (in a broader sense, the first operational amplifier configuration register) 122-*n*, and a second n-type differential amplifier configuration register (in a broader sense, the second operational amplifier configuration register) 124-*n*. In FIG. 12, the first n-type differential amplifier configuration register 122-*n* and the second n-type differential amplifier configuration register 124-*n* are each composed of a 6-bit D-FF.

A command configuration signal CMDD is input to the clock terminal C of the D-FF, each composing the first n-type differential amplifier configuration register 122-*n*. The signal for each bit of the command data CMD <0:5> is input to the data input terminal D of the D-FF, each composing the first n-type differential amplifier configuration register 122-*n*. A command configuration signal CMDC is input to the clock terminal C of the D-FF, each composing the second n-type differential amplifier configuration register 124-*n*. The signal for each bit of the command data CMD <0:5> is input to the data input terminal D of the D-FF, each composing the second n-type differential amplifier configuration register 124-*n*.

Command configuration signals CMDA, CMDB, CMDC, and CMDD are pulse signals provided when the configuration commands for setting configuration data (first and second pieces of configuration data) are input to each differential amplifier configuration register from the host or the display controller. The command data CMD <0:5> is the command data output from the host or the display controller 38.

A configuration data, which determines the amount of current of the current source for the p-type differential amplifier of the operational amplifier 110 during the control time CT, is set to the first p-type differential amplifier configuration register 122-*p*. The configuration data, which determines the amount of current of the current source for the p-type differential amplifier of the operational amplifier 110 for a period except during the control time CT, is set to the second p-type differential amplifier configuration register 124-*p*.

The configuration data, which sets the amount of current of the current source for the n-type differential amplifier of the operational amplifier 110 during the control time CT, is set to the first n-type differential amplifier configuration register 122-*n*. The configuration data, which sets the amount of current of the current source for the n-type differential amplifier of the operational amplifier 110 for a rest of the period except during the control time CT, is set to the second n-type differential amplifier configuration register 124-*n*.

The control signal SRCNT and the polarity inversion signal POL are input to the operational amplifier control circuit 120 with such structure. Then, when the polarity inversion signal POL is at H-level, and the control signal SRCNT is at H-level, the signals, which correspond to the configuration data of the first p-type differential amplifier configuration register 122-*p*, are output as p-type differential amplifier control signals VREFP1 through VREFP6 (in a broader sense, operational amplifier control signal). Moreover, when the polarity inversion signal POL is at H-level, and the control signal SRCNT is at L-level, the signals, which correspond to the configuration data of the second p-type differential amplifier configuration register 124-*p*, are output as the p-type differential amplifier control signals VREFP1 through VREFP6. Furthermore, when the polarity inversion signal POL is at L-level, and the control signal SRCNT is at H-level, the signals, which correspond to the configuration data of the first n-type differential amplifier configuration register 122-*n*, are output as n-type differential amplifier control signals VREFN1 through VREFN6. Still further, when the polarity inversion signal POL is at L-level, and the control signal SRCNT is at L-level, the signals, which correspond to the configuration data of the second n-type differential amplifier configuration register 124-*n*, are output as the n-type differential amplifier control signals VREFN1 through VREFN6.

The control signal SRCNT is output as is as a boost signal BOOSTN, and the inverted signal of the control signal SRCNT is output as a boost BOOSTP.

In FIG. 12, the first p-type differential amplifier configuration register 122-*p* and the first n-type differential amplifier configuration register 122-*n* are provided as the first operational amplifier configuration register, and the second p-type differential amplifier configuration register 124-*p* and the second n-type differential amplifier configuration register 124-*n* are provided as the second operational amplifier configuration register. Moreover, the boost signals BOOSTP and BOOSTN are activated only during the control period CT. The aforementioned structure shall not limit the invention.

For instance, another possible structure may include: the configuration register, provided as the first operational amplifier configuration register, which can set the configuration data (control information) for increasing the electric current drive capacity of the operational amplifier 110; and the configuration register, provided as the second operational amplifier configuration register, which can set the configuration data for setting the electric current drive capacity of the operational amplifier 110 in its normal status. In this case, during the control time CT, the electric current drive capacity of the operational amplifier 110 is increased based on the configuration information of the first operational amplifier configuration register, and the rest of the period except during the control time CT, the electric current drive capacity of the operational amplifier 110 is increased based on the configuration information of the second operational amplifier configuration register.

As described, the operational amplifier control circuit 120 may include: the first operational amplifier configuration register, with which the first configuration data for setting either one or both of the slew rate and the electric current drive capacity of the operational amplifier 110 is specified; and the second operational amplifier configuration register, with which the second configuration data for setting either one or both of the slew rate and the electric current drive capacity of the operational amplifier 110 is specified. Moreover, during the control time, the operational amplifier control circuit 120 can perform a control of either one or both of the slew rate and the electric current drive capacity of the operational amplifier 110, based on the first configuration data; and after the duration of the control time, it can perform a control of either one or both of the slew rate and the electric current drive capacity of the operational amplifier 110, based on the second configuration data.

Figure 13:
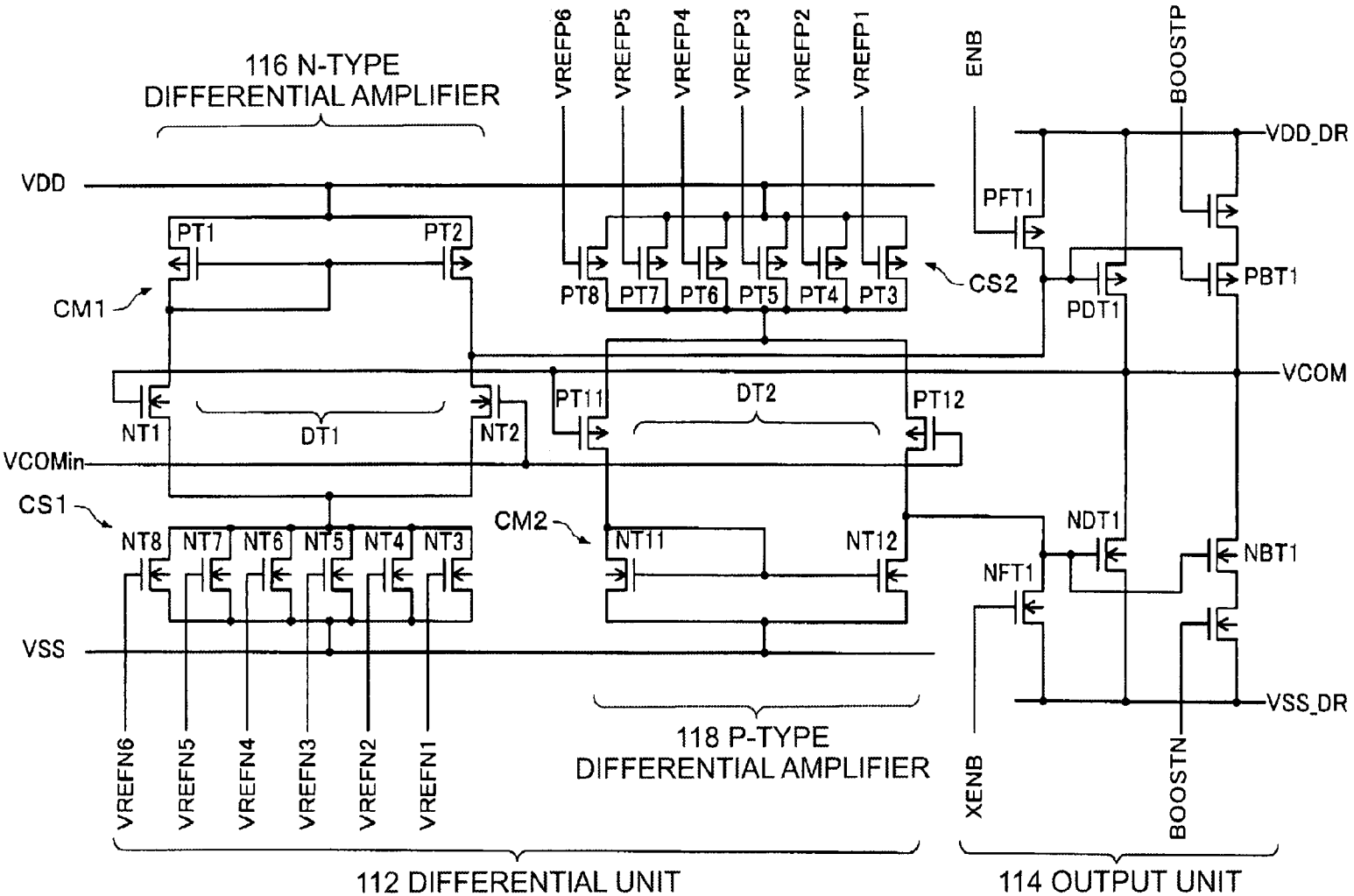
FIG. 13 is the illustration that describes the circuitry in the example structure of an operational amplifier.

In FIG. 13, a circuit diagram of the example structure of the operational amplifier 110 in FIG. 8 is shown.

The p-type differential amplifier control signals VREFP1 through VREFP6, the n-type differential amplifier control signals VREFN1 through VREFN6, and the boost signals BOOSTP and BOOSTN, are input from the operational control circuit 120 in FIG. 12 to this operational amplifier 110.

The operational amplifier 110 includes a differential section 112 and an output section 114. The differential section 112 includes an n-type differential amplifier 116 and a p-type differential amplifier 118.

The n-type differential amplifier 116 includes a current mirror circuit CM1, a differential transistor pair DT1, and a current source CS1. The current mirror circuit CM1 includes p-type Metal Oxide Semiconductor (MOS) transistors (hereafter p-type transistors) PT1 and PT2, whose sources are connected to the source voltage VDD at the high potential. The gates of the p-type transistors PT1 and PT2 are interconnected, and the gate and the drain of the p-type transistor PT1 are connected.

The differential transistor pair DT1 includes n-type MOS transistors (hereafter n-type transistors) NT1 and NT2. The output voltage VCOM (previously referred to as "counter electrode voltage VCOM", hereafter referred to as "output voltage VCOM") of the output section 114 is supplied to the gate of the n-type transistor NT1. The input voltage VCOMin of the operational amplifier 110 is supplied to the gate of the n-type transistor NT2. The drain of the n-type transistor NT1 is connected to the drain of the p-type transistor PT1. The drain of the n-type transistor NT2 is connected to the drain of the p-type transistor PT2.

The current source CS1 is inserted between the sources of the n-type transistors NT1 and NT2, and the source voltage VSS at the low potential. In such current source CS1, each of the six n-type transistors NT3 through NT8 are connected in parallel. The n-type differential amplifier control signals VREFN1 through VREFN6 are supplied to the gates of the n-type transistor NT3 through NT8. Therefore, the amount of current for the current source CS1 is controlled, corresponding to the n-type differential amplifier control signals VREFN1 through VREFN6.

At the same time, the p-type differential amplifier 118 also includes a current mirror circuit CM2, a differential transistor pair DT2, and a current source CS2. The current mirror circuit CM2 includes n-type transistors NT11 and NT 12, whose sources are connected to the source voltage VSS. The gates of the n-type transistors NT11 and NT12 are interconnected, and the gate and the drain of the n-type transistor NT11 are connected.

The differential transistor DT1 includes p-type transistors PT11 and PT12. The output voltage VCOM of the output section 114 is supplied to the gate of the p-type transistor PT11. The input voltage VCOMin of the operational amplifier 110 is supplied to the gate of the p-type transistor PT12. The drain of the p-type transistor PT11 is connected to the drain of the n-type transistor NT11. The drain of the p-type transistor PT12 is connected to the drain of the n-type transistor NT12.

The current source CS2 is inserted between the sources of the p-type transistors PT11 and PT 12, and the source voltage VDD. In such current source CS2, each of the six p-type transistors PT3 through PT8 are connected in parallel. The p-type differential amplifier control signals VREFP1 through VREFP6 are supplied to the gates of the p-type transistors PT3 through PT8. Therefore, the amount of current for the current source CS2 is controlled, corresponding to the p-type differential amplifier control signals VREFP1 through VREFP6.

The output section 114 includes a p-type drive transistor PDT1 and an n-type drive transistor NDT1. A source voltage VDD_DR for driving at the high potential is supplied to the source of the p-type drive transistor PDT1. A source voltage VSS_DR for driving at the low potential is supplied to the source of the n-type drive transistor NDT1. The voltage at the connection node of the n-type transistor NT2 and the p-type transistor PT2 in the n-type differential amplifier 116 is supplied to the gate of the p-type drive transistor PDT1. The voltage at the connection node of the p-type transistor PT12 and the n-type transistor NT12 in the p-type differential amplifier 118 is supplied to the gate of the n-type drive transistor NDT1. The drain of the p-type drive transistor PDT1 and the drain of the n-type drive transistor NDT1 are connected, and the voltage of either of the drains becomes the output voltage VCOM.

In FIG. 13, transistors PFT1 and NFT1 for fixing gate voltage are installed, so that the output of the operational amplifier 110 can be set to an high impedance state with an enable signal ENB and its inverted signal XENB. The enable signals ENB and XENB are supplied to the gates of the transistors PFT1 and NFT1 for fixing gate voltage, and the gate voltages of the p-type drive transistor PDT1 and the n-type drive transistor NDT1 are fixed to the VDD_DR and VSS_DR, so that the output can be set to the high impedance state.

In the output section 114, a p-type drive transistor for boost PBT1 is installed in parallel to the p-type drive transistor PDT1. More specifically, the p-type drive transistor for boost PBT1 is connected to the p-type drive transistor PDT1 in parallel, when the boost signal BOOSTP is at L-level. Consequently, corresponding to the boost signal BOOSTP, the capacity to push current to the output can be increased.

Similarly, in the output section 114, an n-type drive transistor for boost NBT1 is installed in parallel to the n-type drive transistor NDT1. More specifically, the n-type drive transistor for boost NBT1 is connected to the n-type drive transistor NDT1 in parallel, when the boost signal BOOSTN is in "H" level. Consequently, corresponding to the boost signal BOOSTN, the capacity to pull current from the output can be increased.

Hereafter, the case of the input voltage VCOMin being higher than the output voltage VCOM is described, with focus on the n-type differential amplifier 116 in the operational amplifier 110 with the aforementioned structure.

In this case, since the impedance of the n-type transistor NT1 becomes larger than that of the n-type transistor NT1, the gate voltage of the p-type transistors PT1 and PT2 rises; hence the impedance of the p-type transistor PT2 increases. Consequently, the gate voltage of the p-type drive transistor PDT1 falls, and the p-type drive transistor PDT1 is activated.

At the same time, with focus on the p-type differential amplifier 118, in the case of the input voltage VCOMin being higher than the output voltage VCOM, the impedance of the p-type transistor PT11 becomes smaller than that of the p-type transistor PT12, the gate voltage of the n-type transistors NT11 and NT12 rises; hence the impedance of the n-type transistor NT12 decreases. Consequently, the gate voltage of the n-type drive transistor NDT1 falls, and the n-type drive transistor NDT1 is deactivated.

As described, in the case of the input voltage VCOMin being higher than the output voltage VCOM, the p-type drive transistor PDT1 and the n-type drive transistor NDT1 are activated so that the output voltage VCOM increases. In case of the input voltage VCOMin being lower than the output voltage VCOM, the opposite operation mentioned above is performed. As a result of the aforementioned operation, in the operational amplifier 110, the input voltage VCOMin and the output voltage VCOM transit toward matched status where both voltages are approximately the same.

Here, in the n-type differential amplifier 116, the larger the amount of current of the current source CS1 becomes, the response speed of each transistor composing the current mirror circuit CM1 and the differential transistor pair DT1 can be increased; thus the slew rate of the operational amplifier 110 can be increased. Similarly, in the p-type differential amplifier 118, the larger the amount of current of the current source CS2 becomes, the response speed of each transistor composing the current mirror circuit CM2 and the differential transistor pair DT2 can be increased; thus the slew rate of the operational amplifier 110 can be increased.

Moreover, in the output section 114, by activating the p-type drive transistor for boosting PBT1 or the n-type drive transistor for boosting NBT1, the electric current drive capacity can be increased.

In the case where the operational amplifier 110 shown in FIG. 13 drives the counter electrode of the liquid crystal display panel 20, the slew rate and the electric current drive capacity of the operational amplifier 110 can be adjusted as described hereafter, utilizing the relationship between the load of the counter electrode and frequencies of the polarity inversion.

If the load of the counter electrode is low and the frequency of polarity inversion is high, only the slew rate of the operational amplifier 110 needs to be increased. This is applicable to the case where the load of the counter electrode is small, even if the number of display pixel of the liquid crystal display panel 20 increases. For instance, even when the sizes of the Quarter Video Graphics Array (QVGA) panel and the Video Graphics Array (VGA) are the same, the frequency of the polarity inversion needs to be doubled.

If the load of the counter electrode is high, then only the electric current drive capacity of the operational amplifier 110 needs to be increased. This is applicable to the case where the load of the counter electrode varies according to manufacturers, while the frequencies of the electrode inversion are the same.

If the load of the counter electrode is high and the frequency of polarity inversion is high, the slew rate and the electric current drive capacity of the operational amplifier 110 need to be increased. This is applicable to the case where the number of display pixel of the liquid crystal display panel 20 increases. For instance, in the case of modifying the panel from the QVGA panel to the VGA panel, the load of the counter electrode increases and the frequency of polarity inversion needs to be high.

Figure 14:
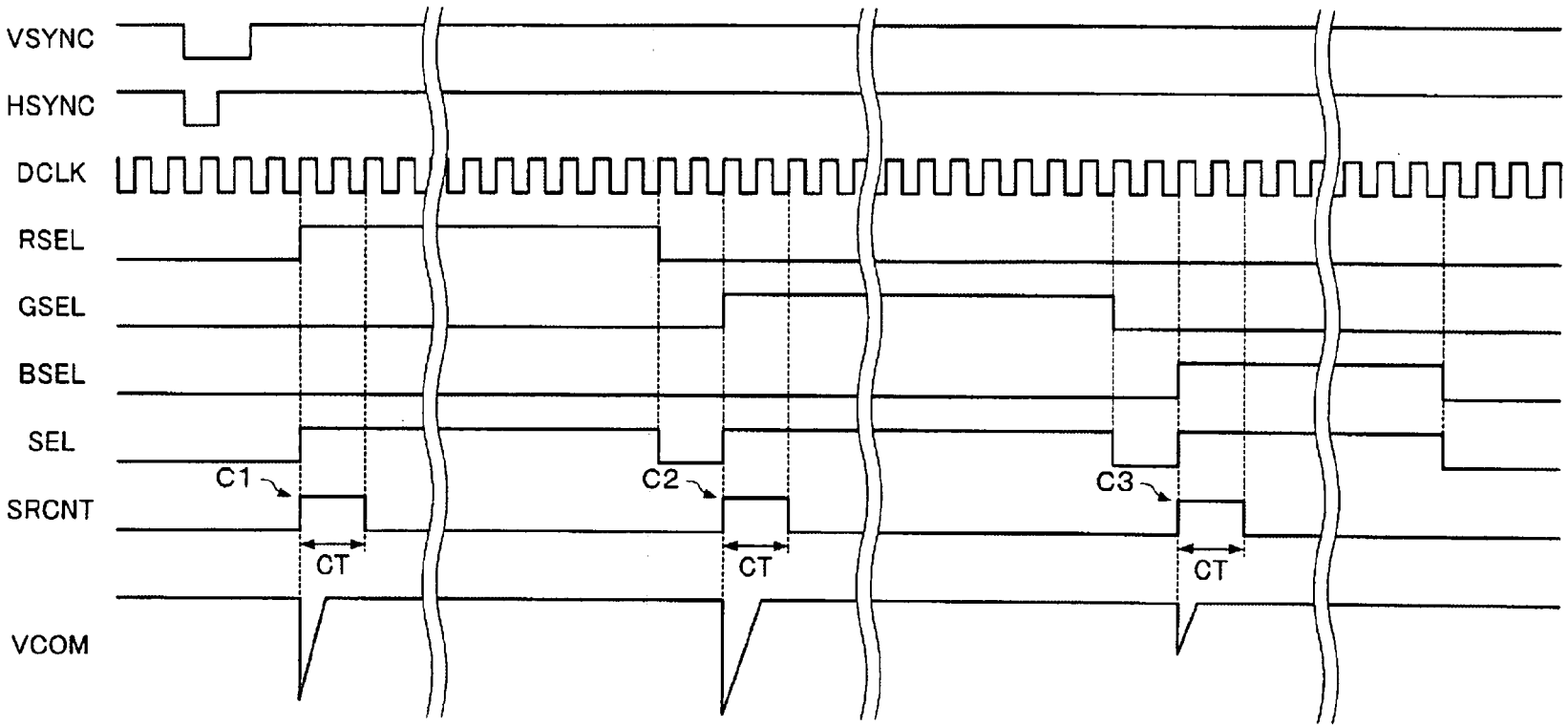
FIG. 14 is the timing chart of the operation example of the power supply circuit in the embodiment.

In FIG. 14, the timing chart of the operation example of the power supply circuit 100 in the embodiment is shown.

FIG. 14 illustrates an example of the operation of the power supply circuit 100 with the structure described in FIGS. 10 through 13, when the electrode inversion signal POL is at "H" level. Moreover, in the timer circuit 160, "2" clock ticks is selected in the dot clock DCLK.

Once the horizontal synchronization signal HSYNC changes from the L-level to H-level and a horizontal scanning period starts, the multiplex drive control circuit 350 generates the multiplex signals Rsel, Gsel, and Bsel. As shown in FIG. 14, attributed to the change of the multiplex signal Rsel, the write-in signal SEL changes to H-level (C1). From this point on, the control signal SRCNT is at H-level only during 2 clock ticks of the dot clock DCLK, where this period of the control signal SRCNT being at H-level becomes the control time CT.

Further, the operational amplifier 110 is controlled, corresponding to the p-type differential amplifier control signals VREFP1 through VREFP6, the n-type differential amplifier control signals VREFN1 through VREFN6, and the boost signals BOOSTP and BOOSTN, which are set in advance for the control time CT. During this control period CT, the operational amplifier 110 can drive the counter electrode with a high throughput or a high electric current drive capacity.

Thereafter, after the duration of the control time CT, the status of the p-type differential amplifier control signals VREFP1 through VREFP6, the n-type differential amplifier control signals VREFN1 through VREFN6, and the boost signals BOOSTP and BOOSTN are brought back to their original state, and the operational amplifier 110 drives the counter electrode with a lower throughput or a lower electric current drive capacity.

Similarly, due to the change of the multiplex signal Gsel, the write-in signal SEL changes again to H-level (C2). From this point on, the control signal SRCNT is at H-level only during 2 clock ticks of the dot clock DCLK, where this period of the control signal SRCNT being at H-level becomes the control time CT.

Furthermore, due to the change of the multiplex signal Bsel, the write-in signal SEL changes to the H-level (C3). From this point on, the control signal SRCNT is in "H" level only during 2 clock ticks of the dot clock DCLK, where this period of the control signal SRCNT being in H-level becomes the control time CT.

In the embodiment, the length of the control time CT is the same for each color component. However, it shall not be limited to this configuration, and may also include a configuration that allows setting the length of the control time CT per color component.

As described, according to the embodiment, the control of either one or both of the slew rate and the electric current drive capacity is performed, only at the time of bringing the fluctuated voltage level of the counter electrode back to the original. Thereafter, the operational amplifier drives with the original slew rate and the electric current drive capacity.

Consequently, the output capacity of the operational amplifier 110 can be increased only when necessary, so that during the rest of the period, the output capacity of the operational amplifier 110 can be decreased; therefore, the power consumption can be suppressed to its minimum.

4. Electronic Apparatus

Figure 15:
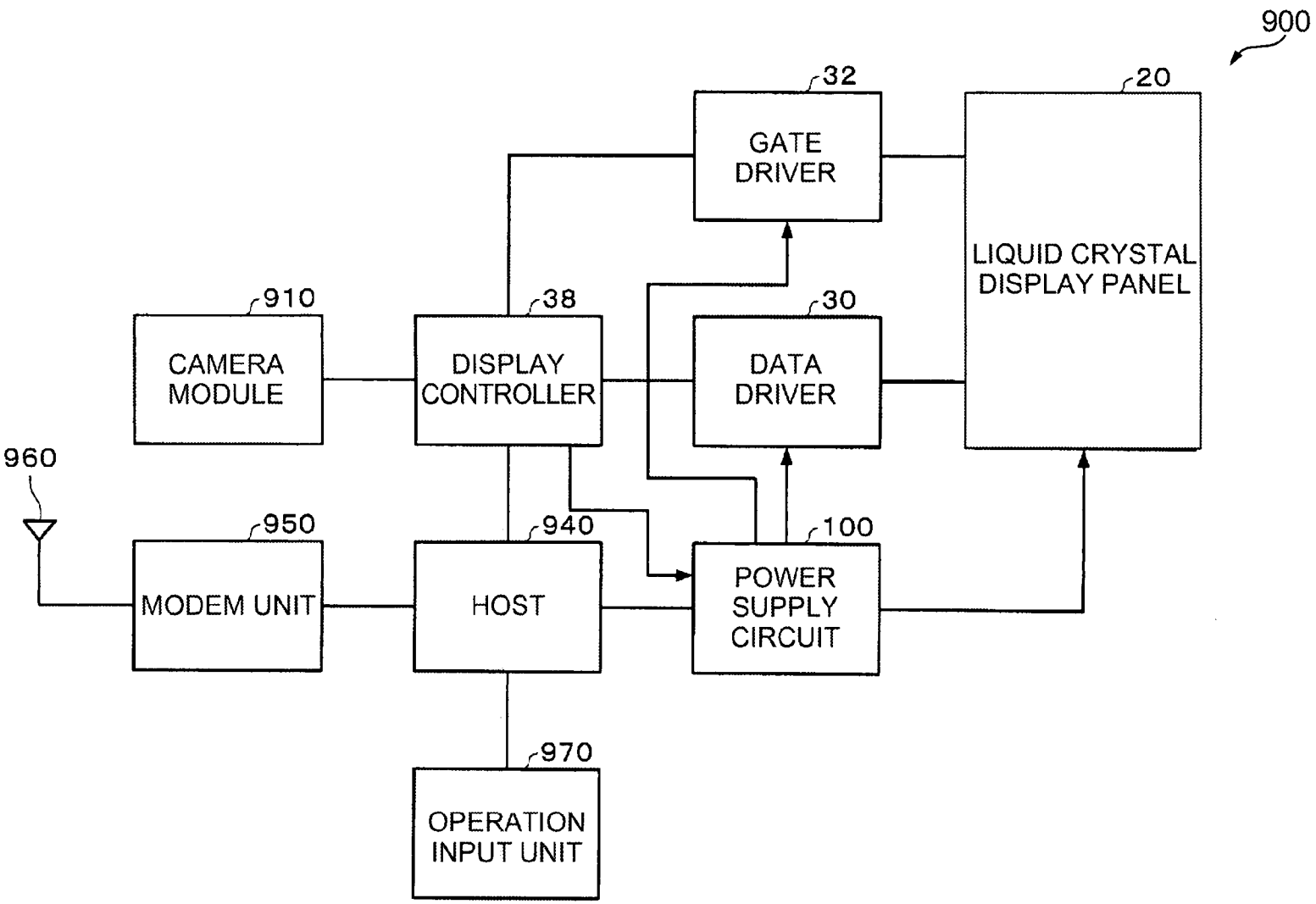
FIG. 15 is the block diagram of the example structure of an electronic apparatus in the embodiment.

In FIG. 15, the block diagram of the example structure of an electronic apparatus in the embodiment is shown. Here, a mobile phone is shown in the block diagram as an example of the electronic apparatus. The same signs and numerals are used for the same parts as in FIGS. 1 and 2, and their descriptions are omitted appropriately in FIG. 15.

A mobile phone 900 includes a camera module 910. The camera module 910 includes a CCD camera, and supplies the data of the image photographed by the CCD camera, to the display controller 38 in a YUV format.

The mobile phone 900 includes the liquid crystal display panel 20. The liquid crystal display panel 20 is driven by the data driver 30 and the gate driver 32. The liquid crystal display panel 20 includes a plurality of gate lines, source lines, and pixels.

The display controller 38 is connected to the data driver 30 and to the gate driver 32, and supplies the display data in RGB format to the data driver 30.

The power circuit 100 is connected to the data driver 30 and to the gate driver 32, and supplies the source voltage to each of the drivers for driving them. Moreover, the counter electrode voltage VCOM is supplied to the counter electrode of the liquid crystal display panel 20.

The host 940 is connected to the display controller 38. The host 940 controls the display controller 38. Further, the host 940 allows a demodulation of the display data received through an antenna 960 in a modem part 950, and then allows a supply of the data to the display controller 38. Based on this display data, the display controller 38 displays an image in the liquid crystal display panel 20, with the data driver 30 and the gate driver 32.

The host 940 can modulate the display data generated by the camera module 910 at the modem part 950, and can subsequently command the transmission of the data to another communication device through the antenna 960.

The host 940 conducts the send/receive processing of the display data, the imaging with the camera module 910, and the display processing of the liquid crystal display panel 20, based on the operational information from an operation input section 970.

In the above-mentioned embodiment, the start timing of the write-in to the pixel electrode is set to time-division timing of the multiplexed signal. However, the invention shall not be limited to this configuration. It goes without saying that in the case where the data driver drives each data line without using the multiplexed signal, a drive start timing of each data line becomes the start timing of the write-in to the pixel electrode.

Moreover, in the case of using the multiplexed signal as in the embodiment, drive voltages, each of which corresponds to the display data for each of the three dots that constitute one pixel, are multiplexed in time-division. However, the invention shall not be limited to this configuration. For instance, another configuration for a multiplexed signal may include: drive voltages, where each of them corresponding to the display data for 6 dots that constitutes two pixels, are multiplexed in time-division into the multiplex signal; or drive voltages, where each of them corresponding to the display data for 9 dots that constitute three pixels, are multiplexed in time-division into the multiplex signal. The invention does not limit the number of dots that constitute one pixel. The multiplexed signal can be any multiplexed signal as far as each dot in the display data is multiplexed in time-division.

The present invention shall not be limited to the embodiments mentioned above, and within the main scope of the present invention, it is possible to implement the present invention with other kinds of modifications. For example, the invention can be applied, not only to the driving of the above-mentioned liquid crystal display panel, but also to the driving of an electro-luminescence or plasma display device.

Part of requirements of any claim of the present invention could be omitted from a dependent claim which depends on that claim. Moreover, part of requirements of any independent claim of the present invention could be made to depend on any other independent claim.

Although only some embodiments of the present invention have been described in detail above, those skilled in the art will readily appreciate that many modifications are possible in the embodiments without materially departing from the novel teachings and advantages of this invention. Accordingly, all such modifications are intended to be included within scope of this invention.

What is claimed is:

1. A power supply circuit for supplying a voltage to a counter electrode which faces a pixel electrode in an electro-optic device, an electro-optic material being disposed between the counter electrode and the pixel electrode, the power supply circuit comprising:

an operational amplifier which drives the counter electrode; and an operational amplifier control circuit which controls at least one of a slew rate and an electric current drive capacity of the operational amplifier, wherein the operational amplifier control circuit:

increases at least one of the slew rate and the electric current drive capacity of the operational amplifier, during a control time starting at a start timing of a write-in to the pixel electrode, and brings the slew rate and the electric current drive capacity of the operational amplifier back to the state prior to the control time after passing the control time.

2. The power supply circuit as defined by claim 1, wherein the operational amplifier control circuit includes:

a first operational amplifier configuration register in which a first configuration data is set in order to specify at least one of the slew rate and the electric current drive capacity of the operational amplifier; and a second operational amplifier configuration register in which a second configuration data is set in order to specify at least one of the slew rate and the electric current drive capacity of the operational amplifier, and wherein the operational amplifier control circuit controls:

at least one of the slew rate and the electric current drive capacity of the operational amplifier, based on the first configuration data, during the control time; and at least one of the slew rate and the electric current drive capacity of the operational amplifier, after a duration of the control time, based on the second configuration data.

3. The power supply circuit as defined by claim 1, further comprising:

a timer circuit which starts a count after the start timing of the write-in to the pixel electrode, and specifies a period, which is up to a certain count value selected from one or more count values.

4. The power supply circuit, as defined by claim 1, wherein:

in a case where a signal divided from a multiplexed signal is supplied to the pixel electrode, the multiplexed signal being a signal supplied to each data line of a plurality of data lines in the electro-optic device and multiplexed in time-division, the start timing of the write-in is the time-division timing of the multiplex signal.

5. A display driver for driving an electro-optic device including a pixel electrode specified by a scanning line and a data line of the electro-optic device, and a counter electrode which faces the pixel electrode, an electro-optic material being disposed between the counter electrode and the pixel electrode, the display driver comprising:

the power supply circuit as defined by claim 1, which supplies a voltage to the counter electrode; and a driving circuit which drives the electro-optic device.

6. A display driver for driving an electro-optic device including a pixel electrode specified by a scanning line and a data line of the electro-optic device; a counter electrode which faces the pixel electrode, an electro-optic material being disposed between the counter electrode and the pixel electrode; and a demultiplexer for outputting a signal which is divided from a multiplexed signal, to each data line, the display driver comprising:

the power supply circuit as defined by claim 4, which supplies a voltage to the counter electrode;

a multiplexing circuit which generates a multiplexed signal which a signal supplied to each data line of a plurality of data lines in the electro-optic device and multiplexed; and a driving circuit which drives the data line of the electro-optic device, based on the multiplexed signal.

7. An electro-optic device comprising:

a plurality of scanning lines;

a plurality of data lines;

a pixel electrode specified by one of the plurality of scanning lines and one of the plurality of data lines;

a counter electrode facing the pixel electrode, an electro-optic material being disposed between the counter electrode and the pixel electrode;

a demultiplexer for outputting a signal divided from a multiplexed signal, to each data line;

a scanning driver which scans the plurality of scanning lines;

a data driver which drives the plurality of data lines; and the power supply circuit as defined by claim 4, which supplies a voltage to the counter electrode.

8. An electro-optic device comprising:

a plurality of scanning lines;

a plurality of data lines;

a pixel electrode specified by one of the plurality of scanning lines and one of the plurality of data lines;

a counter electrode facing the pixel electrode, an electro-optic material being disposed between the counter electrode and the pixel electrode;

a scanning driver which scans the plurality of scanning lines;

a data driver which drives the plurality of data lines; and the power supply circuit as defined by claim 4 which supplies a voltage to the counter electrode.

9. An electronic apparatus comprising the power supply circuit as defined by claim 1.

10. An electronic apparatus comprising the display driver as defined by claim 5.

11. An electronic apparatus comprising the electro-optic device as defined by claim 7.

* * * * *